US008567696B2

(12) United States Patent
Walker et al.

(10) Patent No.: US 8,567,696 B2
(45) Date of Patent: Oct. 29, 2013

(54) NOZZLE BODY FOR USE WITH IRRIGATION DEVICES

(75) Inventors: Samuel C. Walker, Green Valley, AZ (US); Donald B. Clark, Carlsbad, CA (US); Rowshan Jahan, Tucson, AZ (US)

(73) Assignee: Rain Bird Corporation, Azusa, CA (US)

( * ) Notice: Subject to any disclaimer, the term of this patent is extended or adjusted under 35 U.S.C. 154(b) by 890 days.

(21) Appl. No.: 12/642,470

(22) Filed: Dec. 18, 2009

(65) Prior Publication Data

US 2011/0147488 A1 Jun. 23, 2011

(51) Int. Cl.
*B05B 15/10* (2006.01)

(52) U.S. Cl.
USPC ..... 239/203; 239/391; 239/392; 239/600; 239/204

(58) Field of Classification Search
USPC ..... 239/203, 204, 391, 392, 600
See application file for complete search history.

(56) References Cited

U.S. PATENT DOCUMENTS

| | | | |
|---|---|---|---|
| 567,962 | A | 9/1896 | Cooper |
| 1,015,904 | A | 1/1912 | Niederlander et al. |
| 1,853,805 | A | 4/1932 | Elder |
| 1,996,855 | A | 10/1933 | Cheswright |
| 2,262,585 | A | 11/1941 | Irmischer |
| 2,810,603 | A | 10/1957 | Storch |
| 2,968,440 | A | 1/1961 | Cone |
| 3,046,698 | A | 7/1962 | Breen et al. |
| 3,067,950 | A | 12/1962 | Goldman |
| 3,193,205 | A | 7/1965 | Hanson |
| 3,221,746 | A | 12/1965 | Noble |
| 3,323,725 | A | 6/1967 | Hruby, Jr. |
| 3,454,225 | A | 7/1969 | Hunter |
| 3,711,130 | A | 1/1973 | Betzler |
| 3,794,249 | A | 2/1974 | Lockwood |
| 3,799,453 | A | 3/1974 | Hart |
| 3,940,066 | A | 2/1976 | Hunter |
| 3,957,292 | A | 5/1976 | Diggs |
| 4,095,744 | A | 6/1978 | Villelli |
| 4,316,579 | A | 2/1982 | Ray et al. |
| 4,351,477 | A | 9/1982 | Choi |
| 4,353,506 | A | 10/1982 | Hayes |
| 4,459,318 | A | 7/1984 | Hyans |
| 4,522,339 | A | 6/1985 | Costa |
| 4,583,767 | A | 4/1986 | Hansen |
| 4,597,594 | A | 7/1986 | Kacalieff et al. |
| 4,729,511 | A | 3/1988 | Citron |
| 4,752,033 | A | 6/1988 | Groendyke |
| 4,787,557 | A | 11/1988 | Jackson |
| 4,787,558 | A | 11/1988 | Sexton et al. |

(Continued)

FOREIGN PATENT DOCUMENTS

| | | |
|---|---|---|
| CN | 202082527 | 12/2011 |

OTHER PUBLICATIONS

Rain Bird's Xeri-Pops Tech Specs, 2005 Rain Bird Corporation Jan. 2005.
U.S. Appl. No. 12/972,271, filed Dec. 17, 2010.

(Continued)

*Primary Examiner* — Dinh Q Nguyen
(74) *Attorney, Agent, or Firm* — Fitch, Even, Tabin & Flannery LLP

(57) ABSTRACT

A unitary nozzle body is provided for use with an irrigation device, such as a pop-up irrigation device.

10 Claims, 18 Drawing Sheets

(56) References Cited

U.S. PATENT DOCUMENTS

| | | | | |
|---|---|---|---|---|
| 4,790,481 | A | 12/1988 | Ray et al. | |
| 4,819,875 | A | 4/1989 | Beal | |
| 4,834,292 | A | 5/1989 | Dyck | |
| 4,844,516 | A | 7/1989 | Baker | |
| 4,875,719 | A | 10/1989 | Mylett | |
| 4,913,352 | A | 4/1990 | Witty et al. | |
| 4,984,740 | A | 1/1991 | Hodge | |
| 5,063,968 | A | 11/1991 | Bartholomew | |
| 5,098,021 | A * | 3/1992 | Kah, Jr. | 239/242 |
| 5,163,618 | A | 11/1992 | Cordua | |
| 5,265,802 | A | 11/1993 | Hobbs et al. | |
| 5,265,803 | A | 11/1993 | Thayer | |
| 5,351,674 | A | 10/1994 | Hawks | |
| 5,415,348 | A | 5/1995 | Nelson | |
| 5,487,571 | A | 1/1996 | Robertson | |
| 5,507,436 | A | 4/1996 | Ruttenberg | |
| 5,613,802 | A | 3/1997 | Farrell | |
| 5,636,937 | A | 6/1997 | Zemlicka | |
| 5,642,861 | A * | 7/1997 | Ogi et al. | 239/568 |
| 5,709,415 | A | 1/1998 | Witter | |
| 5,779,148 | A | 7/1998 | Saarem et al. | |
| 5,947,386 | A | 9/1999 | Dick et al. | |
| D415,415 | S | 10/1999 | Robertson | |
| 6,007,001 | A | 12/1999 | Hilton | |
| 6,035,887 | A | 3/2000 | Cato | |
| 6,045,059 | A | 4/2000 | Weller | |
| 6,234,411 | B1 | 5/2001 | Walker | |
| 6,299,075 | B1 | 10/2001 | Koller | |
| 6,499,678 | B1 | 12/2002 | Hope | |
| 6,505,861 | B2 | 1/2003 | Butterfield et al. | |
| 6,520,265 | B2 | 2/2003 | Winebrenner | |
| 6,536,718 | B2 | 3/2003 | Benito-Navazo | |
| 6,561,550 | B1 | 5/2003 | Kiraz | |
| 6,568,608 | B2 | 5/2003 | Sirkin | |
| 6,637,672 | B2 | 10/2003 | Cordua | |
| D486,884 | S | 2/2004 | Gregory | |
| 6,719,330 | B2 | 4/2004 | Brown et al. | |
| 6,732,950 | B2 | 5/2004 | Ingham, Jr. et al. | |
| 6,758,410 | B2 | 7/2004 | Kuo | |
| 6,799,732 | B2 | 10/2004 | Sirkin | |
| 6,837,448 | B2 | 1/2005 | Han et al. | |
| 6,997,393 | B1 | 2/2006 | Angold et al. | |
| 7,021,672 | B2 | 4/2006 | Ericksen et al. | |
| 7,048,208 | B1 | 5/2006 | Pruitt et al. | |
| 7,226,003 | B2 | 6/2007 | Kah, Jr. et al. | |
| 7,234,651 | B2 | 6/2007 | Mousavi et al. | |
| 7,234,652 | B2 | 6/2007 | Rodeman | |
| 7,255,291 | B1 | 8/2007 | Lo | |
| 7,303,153 | B2 * | 12/2007 | Han et al. | 239/461 |
| 7,322,533 | B2 | 1/2008 | Grizzle | |
| D562,939 | S | 2/2008 | Lo et al. | |
| 7,325,753 | B2 | 2/2008 | Gregory et al. | |
| 7,360,718 | B2 | 4/2008 | Yeh | |
| 7,419,194 | B2 | 9/2008 | Feith | |
| 7,472,840 | B2 | 1/2009 | Gregory | |
| 7,500,619 | B2 | 3/2009 | Lockwood | |
| 7,500,620 | B2 | 3/2009 | Cordua | |
| 7,581,687 | B2 | 9/2009 | Feith et al. | |
| 7,597,276 | B2 | 10/2009 | Hawkins | |
| 7,611,077 | B2 | 11/2009 | Sesser et al. | |
| 7,621,464 | B2 | 11/2009 | Smith et al. | |
| 7,621,467 | B1 * | 11/2009 | Garcia | 239/457 |
| 7,644,870 | B2 | 1/2010 | Alexander et al. | |
| 7,654,474 | B2 | 2/2010 | Cordua | |
| 7,677,474 | B2 | 3/2010 | Markley et al. | |
| 7,681,807 | B2 | 3/2010 | Gregory | |
| 7,686,235 | B2 | 3/2010 | Roberts | |
| 7,686,236 | B2 | 3/2010 | Alexander | |
| 7,726,587 | B2 | 6/2010 | Markley et al. | |
| D620,550 | S | 7/2010 | Feith et al. | |
| 7,766,259 | B2 | 8/2010 | Feith et al. | |
| 7,770,821 | B2 | 8/2010 | Pinch | |
| 7,793,868 | B2 | 9/2010 | Kah, Jr. et al. | |
| 7,823,804 | B2 | 11/2010 | Cordua | |
| 7,841,547 | B2 | 11/2010 | Kah, Jr. et al. | |
| 7,850,094 | B2 | 12/2010 | Richmond et al. | |
| 7,861,948 | B1 | 1/2011 | Crooks | |
| 7,900,851 | B2 | 3/2011 | Ruttenberg | |
| 8,011,604 | B1 | 9/2011 | Holtsnider et al. | |
| 8,038,082 | B2 | 10/2011 | Belford | |
| 8,042,748 | B2 | 10/2011 | Hagaman | |
| 8,047,456 | B2 | 11/2011 | Kah, Jr. et al. | |
| 8,056,829 | B2 | 11/2011 | Gregory | |
| 8,070,189 | B2 | 12/2011 | Yow et al. | |
| 8,074,897 | B2 | 12/2011 | Hunnicutt et al. | |
| 8,079,531 | B2 | 12/2011 | Katzman et al. | |
| 8,083,158 | B2 | 12/2011 | Katzman et al. | |
| 8,109,538 | B2 | 2/2012 | Helstern et al. | |
| 8,113,443 | B2 | 2/2012 | Zur | |
| 2003/0077110 | A1 | 4/2003 | Knowles | |
| 2005/0194464 | A1 | 9/2005 | Bruninga | |
| 2006/0192029 | A1 | 8/2006 | Grizzle | |
| 2006/0283976 | A1 | 12/2006 | Wlodarczyk | |
| 2007/0119976 | A1 | 5/2007 | Kah, Jr. et al. | |
| 2007/0152442 | A1 | 7/2007 | Cleveland et al. | |
| 2007/0235559 | A1 | 10/2007 | Miyake | |
| 2009/0026286 | A1 | 1/2009 | Park | |
| 2009/0032614 | A1 | 2/2009 | Ruttenberg | |
| 2009/0188991 | A1 | 7/2009 | Russell et al. | |
| 2009/0220294 | A1 | 9/2009 | Proulx et al. | |
| 2009/0224070 | A1 | 9/2009 | Clark et al. | |
| 2010/0078508 | A1 | 4/2010 | South et al. | |
| 2010/0090024 | A1 | 4/2010 | Hunnicutt et al. | |
| 2010/0090036 | A1 | 4/2010 | Allen et al. | |
| 2010/0116901 | A1 | 5/2010 | Roney et al. | |
| 2010/0147973 | A1 | 6/2010 | Wang | |
| 2010/0176217 | A1 | 7/2010 | Richmond et al. | |
| 2010/0193603 | A1 | 8/2010 | Lo | |
| 2010/0294854 | A1 | 11/2010 | McAfee et al. | |
| 2011/0024523 | A1 | 2/2011 | Sesser et al. | |
| 2011/0036925 | A1 | 2/2011 | Cordua | |
| 2011/0036933 | A1 | 2/2011 | Kah, Jr. et al. | |
| 2011/0042485 | A1 | 2/2011 | McNulty et al. | |
| 2011/0057048 | A1 | 3/2011 | McAfee | |
| 2011/0068195 | A1 | 3/2011 | Franks et al. | |
| 2011/0079661 | A1 | 4/2011 | Barton | |
| 2011/0084151 | A1 | 4/2011 | Dunn et al. | |
| 2011/0147484 | A1 | 6/2011 | Jahan et al. | |
| 2011/0147489 | A1 | 6/2011 | Walker et al. | |
| 2011/0198410 | A1 | 8/2011 | Curtis | |
| 2011/0248093 | A1 | 10/2011 | Kim | |
| 2011/0248094 | A1 | 10/2011 | Robertson et al. | |
| 2011/0248097 | A1 | 10/2011 | Kim | |
| 2011/0259975 | A1 | 10/2011 | Lo | |
| 2011/0284659 | A1 | 11/2011 | Lo | |
| 2011/0285126 | A1 | 11/2011 | Jahan et al. | |
| 2011/0297757 | A1 | 12/2011 | Schmuckle | |
| 2011/0309160 | A1 | 12/2011 | Kazem et al. | |
| 2011/0309169 | A1 | 12/2011 | Kah, Jr. et al. | |
| 2012/0012670 | A1 | 1/2012 | Kah, Jr. et al. | |
| 2012/0012678 | A1 | 1/2012 | Gregory | |
| 2012/0037722 | A1 | 2/2012 | Shahak et al. | |
| 2012/0043398 | A1 | 2/2012 | Clark | |

OTHER PUBLICATIONS

U.S. Appl. No. 12/642,546, filed Dec. 18, 2009.

Written Opinion of the International Searching Authority and International Search Report issued in International Patent Application No. PCT/US10/61132 on Apr. 19, 2011.

* cited by examiner

NOZZLE BODY FOR USE WITH IRRIGATION DEVICES

FIELD

A nozzle body for use with an irrigation device and, in particular, a unitary nozzle bush body for use with a pop-up irrigation device.

BACKGROUND

Low-pressure irrigation systems can advantageously provide sufficient irrigation for plants while providing for efficient water consumption. One type of low-pressure irrigation system uses supply tubing having a plurality of drip irrigation devices attached thereto for delivering irrigation water to a precise point at a predetermined and relatively low volume flow rate, such as on the order of ½ gallon per hour up to about 24 gallons per hour.

A common type of drip irrigation device is a drip emitter, which can be disposed in or attached to the supply tubing. The drip emitter can tap a portion of the relatively high pressure irrigation water from the supply tubing for flow through a typically long or small cross section flow path to achieve a desired pressure drop prior to discharge at a target trickle or drip flow rate in order to irrigate a local area adjacent the drip emitter. However, it can be desirable to provide for low-pressure irrigation having a larger flow rate than the trickle or drip flow rate typically provided by a drip emitter, as well as to project the irrigation fluid beyond the local area adjacent a drip emitter. To this end, various types of "pop-up" irrigation devices have been provided for use with low-pressure irrigation systems. "Pop-up" irrigation devices are those that include a riser extensible from a housing.

One type of pop-up irrigation device which releases a relatively low volume of water over a relatively small area as compared to conventional pop-up irrigation sprinklers is disclosed in U.S. Pat. No. 5,613,802. However, this device has several disadvantages. For example, the small diameter, generally flexible body and riser may not be as robust as may be needed. Furthermore, the extensive components that must be located above ground (as shown in FIG. 2) are more susceptible to damage.

Often, nozzle bodies are attached to risers using threading. For example, internal threading on a skirt of the nozzle body can mate with external threading on an end of the riser. This permits a nozzle body to be readily attached or removed from the riser, such as for cleaning or to substitute a different nozzle body. Nozzle bodies and risers are often formed by injection molding of plastic into a mold cavity. In order to make the internal and external threading, complex geometries can be formed in the mold cavities and unscrewing mold components can be used to remove the molded components from the mold cavity. However, both can add to the cost and complexity of the mold cavity and mold equipment, thereby increasing the costs associated with manufacturing the components.

SUMMARY

A pop-up irrigation device for use with low-pressure irrigation systems is disclosed. The device is advantageously configured to be more economical to manufacture, have improved reliability in use, and to provide for greater flexibility in the installation of low pressure irrigation systems.

The device has a housing, a riser partially extensible from the housing and a nozzle body removably attached to an end of the riser in a non-threaded manner, such as using a snap-fit.

More specifically, the housing has a sidewall, an open end and a closed end that together define an interior of the housing. At least one, and preferable a pair, connection tube extends laterally from the sidewall of the housing and is in fluid communication with the interior of the housing. The connection tube has an open distal end, spaced from the housing, which is configured to be connectable to flexible irrigation tubing. An annular cap optionally may be attached to the open end of the housing and may include an annular, radially-inward extending seal, which may be fixed. The closed end of the housing can optionally include a depending stake with a plurality of blades to facilitate mounting of the housing relative to the ground.

The riser is partially extendable from within the interior of the housing and through the cap and seal. The riser has a proximal end portion disposed adjacent the closed end of the housing and a distal end portion that is extendable from the housing. The distal end portion of the riser can have a first segment with a first diameter and a second, uppermost segment with a second diameter. The second diameter may be different than the first diameter, and may be less than the first diameter, such that a step is formed between the first and second segments. The second segment can have an upstanding outer wall with an outwardly-facing circumferential groove.

A valve, such as a rotatable plug valve, may optionally be positioned in the first segment of the riser, upstream from the second segment, to control fluid flow through the riser. The valve has an actuator accessible from an exterior of the riser usable to move the plug valve between an open position permitting maximum fluid flow through the valve and a closed position blocking fluid flow through the valve in order to control the distance that fluid is projected from the nozzle. The valve may be recessed within the riser such that it does not interfere with the riser passing through the open end of the housing, including any seal optionally disposed at the open end of the housing.

A seat may be formed in the interior of the riser and can support the valve in a manner that permits rotation of the valve. The seat can have an opening that is selectively restrictable by the valve to control fluid flow from the interior of the housing to the nozzle. In one aspect, the seat can be generally cylindrical and surround the valve, with both an upper opening facing the second segment of the riser and an opposite lower opening. The valve can be shaped as a hollow cylinder with a through port to permit fluid flow through the plug valve. The port may be configured to cooperate with the seat to provide for increasing blockage of the fluid flow when the valve is rotated from its open position to its closed position. The blockage of the fluid flow may increase or decrease either linearly or non-linearly as the plug valve is rotated. The valve can have a closed end with the actuator formed thereon, such as a slot for a screwdriver or other tool. The closed end with the actuator can be accessible through an opening in a sidewall of the riser. The riser may have a longitudinal axis and the valve may have an axis of rotation that is substantially perpendicular to the longitudinal axis of the riser.

A removable, snap on nozzle body is attachable to the second segment of the distal end of the riser. The nozzle body has a top, an outer skirt and at least one orifice for discharging fluid from the interior of the housing via the riser. The skirt can have an inwardly extending protuberance configured to engage the groove of the second segment of the riser to attach the nozzle to the second end of the riser. In one aspect of the nozzle body, the second segment of the distal end portion of the riser can have an upstanding inner wall spaced radially inward from the outer wall. An inner skirt of the nozzle body can be configured to engage, such as in a generally sealing manner, the inner wall of the second segment of the distal end portion of the riser in order to define a fluid chamber between the inner and outer skirts of the nozzle body.

In one version of a nozzle body, there is an inclined deflector disposed below the top of the nozzle body and spaced from an intermediate wall and inclined relative thereto. The deflector can be configured to direct fluid exiting the discharge orifice in a spray pattern, with the discharge orifice extending through the intermediate wall.

In another version, the nozzle body can have a plurality of discharge orifices that are each configured to discharge a stream of fluid. The inner skirt may have a plurality of openings in fluid communication with the discharge orifices and upstream thereof. The size and number of the openings and the size and number of the orifices can optionally be selected to create a pressure drop therebetween. A pressure drop can advantageously be used to control the distance of the throw of the irrigation fluid and can lessen the load on the nozzle, the latter of which can be particularly useful when the nozzle has a snap connection to the riser.

The nozzles described above for use with the afore-mentioned pop-up device can be provided on a unitary nozzle bush. The nozzle bush comprises a carrier with a plurality of different nozzles disposed about its periphery, generally resembling a bush or tree. The nozzle bush can be formed by injection molding plastic to create a unitary body, with the individual nozzles detachable from the carrier as desired. Various tools can be combined with the carrier, such as a flush tool for use in flushing the lines through the device when attached to a device and a nozzle removal tool for use in removing the nozzles when attached to a device.

In one aspect, the nozzle bush includes a carrier having a flush tool. The carrier includes a generally planar body with a centrally-located depending skirt. The skirt has a diameter sized to snap on to the uppermost segment of the riser. More specifically, the skirt has a free end portion with an inwardly extending annular protuberance which permits the carrier to be snapped onto a riser of an irrigation device, such as with the protuberance at least partially inserted into the outwardly facing groove of the riser. The carrier can have an opening coextensive with the skirt and positioned to direct fluid flow outward from the opening in a direction inclined relative to a longitudinal center axis of the skirt when the skirt is attached to the riser during flushing of the irrigation device to direct the exiting fluid away from a user.

A plurality of nozzle bodies can each be removably connected via a bridge to a periphery of the carrier. Each of the nozzle bodies can have a top, an outer skirt and at least one orifice for discharging fluid. The outer skirt can include an inwardly extending protuberance configured to engage the groove of the riser when attached to the riser, and can be designed to attach to the same riser as the skirt of the carrier of the nozzle bush.

DETAILED DESCRIPTION OF THE DRAWINGS

The pop-up irrigation device 10 and components thereof illustrated in FIGS. 1-8 and 16-18 includes a housing 12, a riser 14 partially extensible from within the housing and a nozzle body, exemplary embodiments of which are illustrated in FIGS. 9-15, attached to an end of the riser 14 that is extensible from within the housing 12. A spring 44 biases the riser 14 and hence the nozzle body to a retracted position. When the interior of the housing 12 is pressurized with irrigation fluid, the riser 14 and nozzle body can extend from the housing to an extended position against the biasing force of the spring 44 and irrigation fluid can be discharged through one or more orifices of the nozzle body, as will be discussed in greater detail herein.

Figure 1:
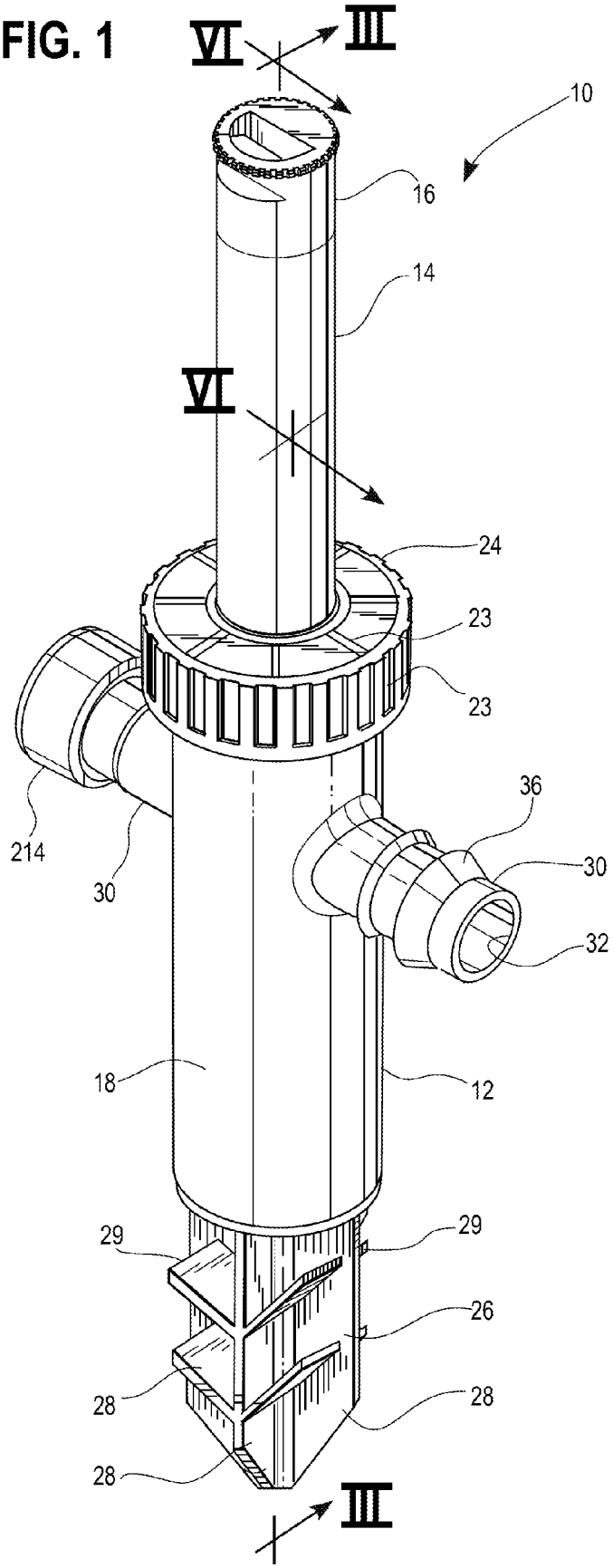
FIG. 1 is a perspective view of a pop-up irrigation device showing a riser in an extended position relative to a housing and with an attached nozzle.
Figure 2:
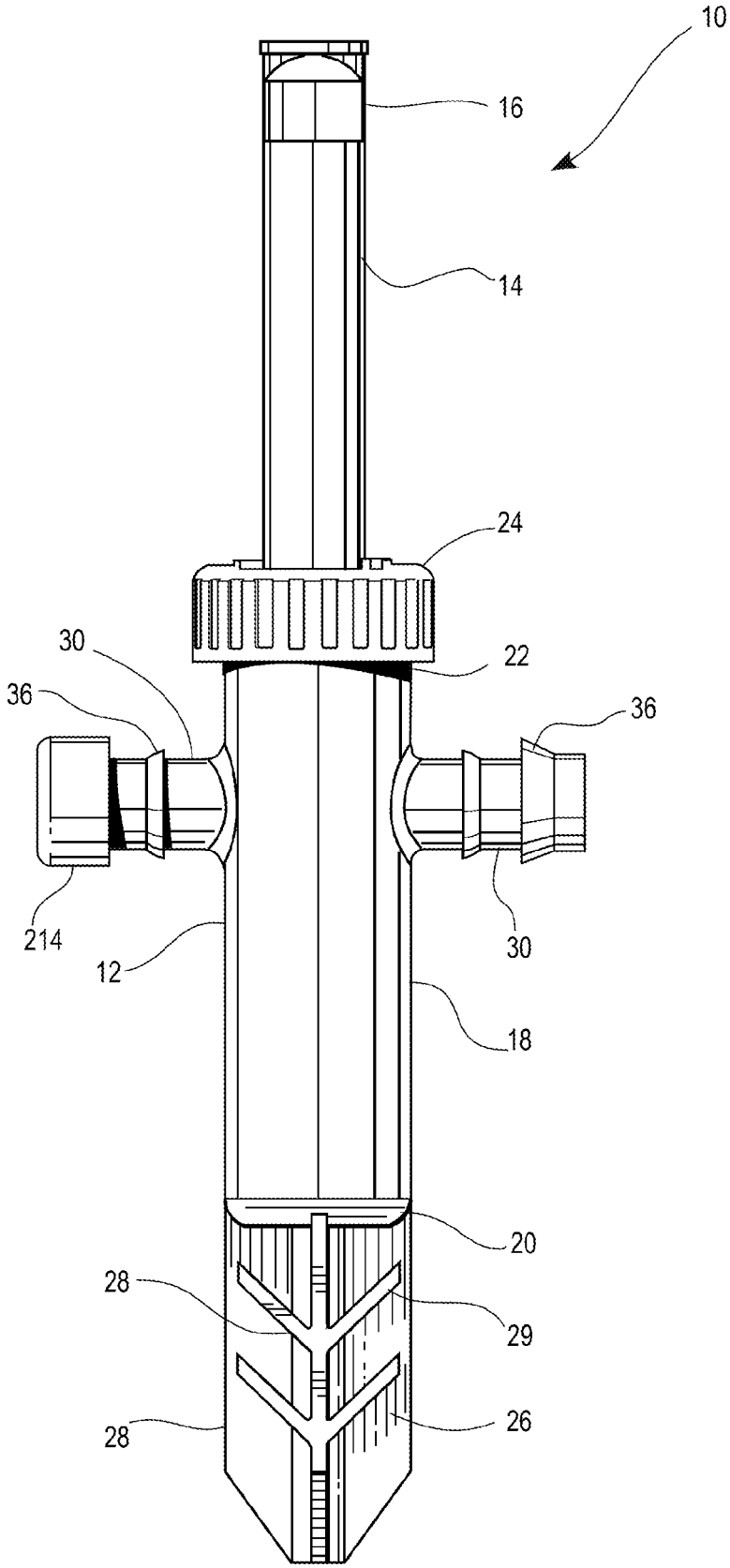
FIG. 2 is a front elevation view of the pop-up irrigation device of FIG. 1 showing the riser in the extended position.
Figure 3:
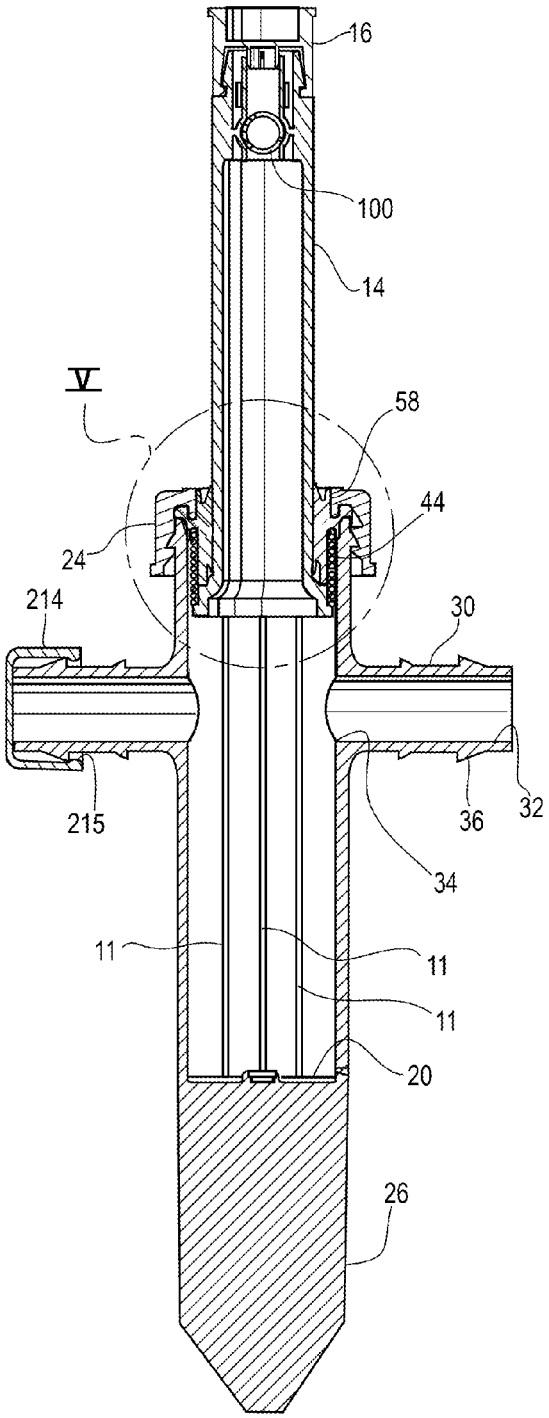
FIG. 3 is a section view of the pop-up irrigation device of FIG. 1 showing the riser in the extended position taken along line III-III of FIG. 1.
Figure 4:
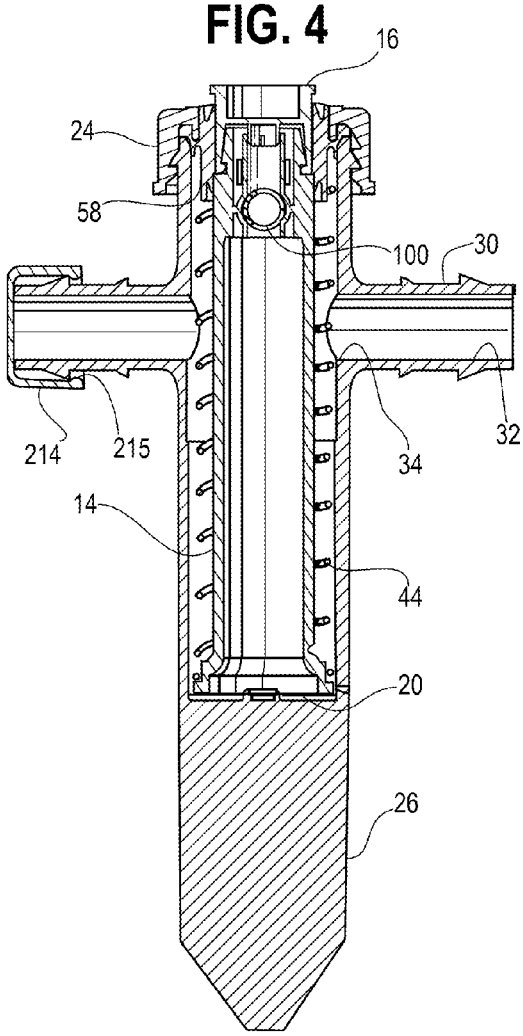
FIG. 4 is a section view of the pop-up irrigation device of FIG. 1 similar to that view shown in FIG. 3 but depicting the riser in a retracted position.

The housing 12 includes a cylindrical sidewall 18 with a closed, lower end 20 and an opposite, upper, open end 22, which together define an interior of the housing 12, as illustrated in FIGS. 3 and 4. A cap 24 is removably attachable to the upper end of the sidewall 18 of the housing 12. The compression spring 44 is disposed within the interior of the housing 12 and biases the riser 16 to its retracted position. When the interior of the housing 12 is sufficiently pressurized with fluid, the riser 14 can shift to its extended position—against the biasing force of the spring 44—to elevate the upper end of the riser 14 and the nozzle body 16 attached thereto above the housing 14, as depicted in FIGS. 1 and 2. The sidewall 18 of the housing 12 has a generally constant inner and outer diameter, with variations contemplated for draft angles and other such modifications for ease of manufacturing when formed of injection-molded plastic.

Figure 5:
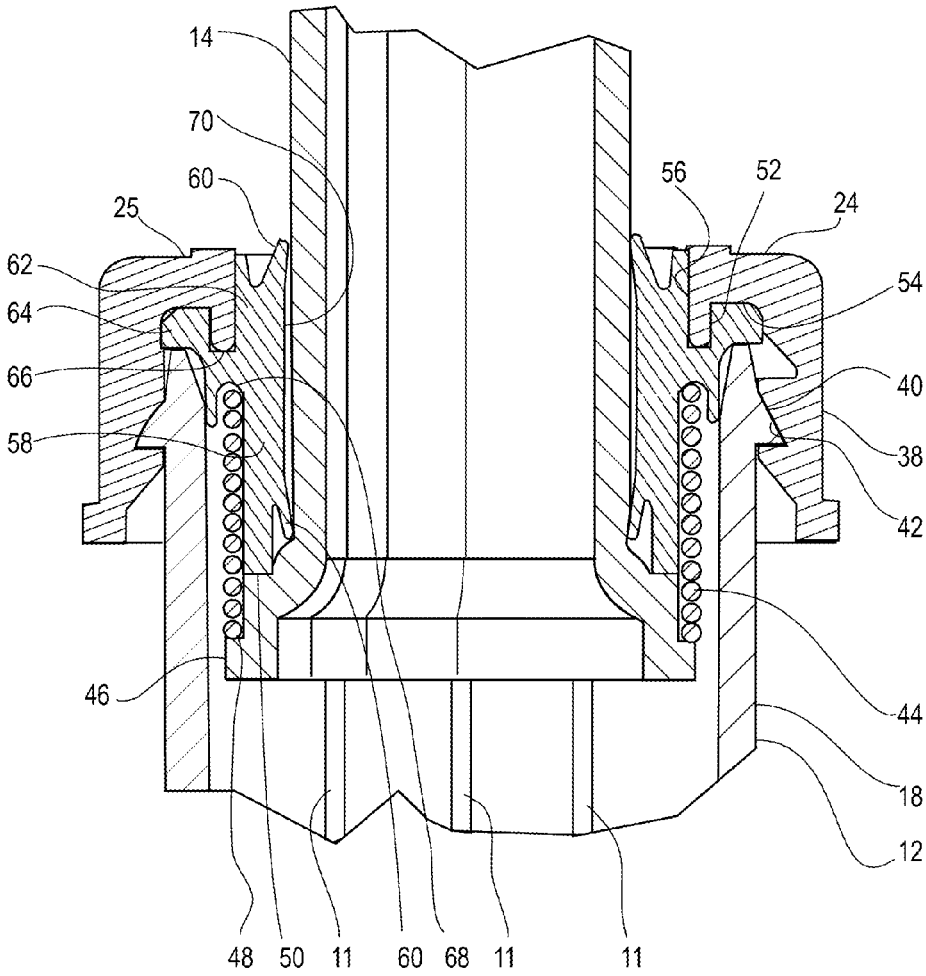
FIG. 5 is a detailed view of region V of the section view of the pop-up irrigation device of FIG. 3 with the riser in the extended position.

The cap 24 has an annular top 25 with a central opening 56, as depicted in FIG. 5. A skirt 38 depends from the periphery of the top 25 of the cap 24 for use in securing the cap 24 to the housing 12. More specifically, the upper end of the sidewall 18 of the housing 12 includes an outer thread 42. The skirt 38 of the cap 24 has an inner thread 40 configured to threadingly engage the outer thread 42 of the sidewall 18 of the housing 12 in order to secure the cap 24 to the housing 12. An annular wiper seal 58 is disposed within the central opening of the top 25 of the cap 24, and includes a central opening 70 through which a middle and top portion of the riser 14 is slidable between its extended and retracted positions. The wiper seal 58 surrounds the riser 14 and restricts fluid from leaking between the riser 14 and the wiper seal 58 and between the cap 24 and the sidewall 18 of the housing 12. Further details of the construction of the wiper seal 58 will be discussed in greater detail below. Raised ribs 23, textures, indicia and the like may be formed on the top and/or skirt of the cap 24 to assist in gripping and rotating the cap 24 to attached or detach the cap 24 from the housing 12.

Extending outward from the sidewall 18 of the housing 12 is a pair of connection ports 30, as illustrated in FIGS. 1-4. The connection ports 30 are each a tubular member having a first open end 32 spaced from the sidewall 18 of the housing 12 and a second, opposite open end 34 in fluid communication with the interior of the housing 12. The connection ports 30 are designed to be connected to a supply of fluid, such as from a pressure regulating valve, or to a downstream pop-up irrigation device 10 or other irrigation device. To this end, one or more barbs 36 may be provided on the exterior of the connection ports 30. A suitable pressure regulating valve is Model No. XCE-100-PRF-BFF, available from Rain Bird Corporation, Azusa, Calif. While two connection ports 30 are illustrated, there could be one connection port, no connection ports, or three or more connection ports. By way of example, when there are two connection ports, one of the connection portions can be connected to tubing for supplying fluid and the other connection port can be connected to tubing for supplying a downstream irrigation device. Alternatively, one of the connection ports can be capped using a snap-on cap 214 (illustrated in FIGS. 9-11) with a skirt having an inwardly-extending protuberance for cooperating with the barb 36 to restrict removal. This is useful when there is no downstream irrigation device that is to be connected to the pop-up irrigation device 10.

The closed end 20 of the housing 12 can optionally include a depending stake 26. The stake 26 includes a plurality radially-outward extending blades 28 which taper as they extend away from the housing 12. Some of the blades can include inclined vanes 29, as illustrated in FIGS. 1 and 2, to further assist in retention of the housing 12 in the ground. Specifically, the vanes 29 can be disposed on a pair of opposing sides of the blades 28. The stake 26 can be inserted into the ground to support the housing 12 relative to the ground. Although in the illustrated embodiment there are four blades 28, any suitable number of blades can be utilized.

The wiper seal 58 has a cylindrical body 62 dimensioned to fit inside the central opening 56 of the cap 24. The central opening 70 of the wiper seal 58 is dimensioned to receive the riser 16. The body has a pair of comparatively thin, inwardly inclined extensions 60 adjacent the top and bottom of the body 62. The extensions 60 are dimensioned to be in general sealing engagement with the riser 16 during the extension and retraction of the riser 16 from the body 12 of the irrigation device 10, as well as when the riser 16 is in its fully extended and fully retracted positions. The inwardly-facing portion of the body 62 disposed between the pair of extensions 60 is preferably spaced from the riser 16 such that friction is reduced during movement of the riser 16. A downward-facing pocket 68 is formed radially outward from the body 62 to receive the upper extent of the spring 44. A generally opposite, upward facing pocket 66 is also formed in the body 62 to receive a depending rim 52 of the underside of the top of the cap 24. A radially-outward extending flange of the body 62, positioned generally adjacent the upward facing pocket 66, is dimensioned to fit into a gap 54 formed between the skirt 38 and the rim 52 of the cap 24, and is positioned to abut an uppermost edge of the housing 12 and the underside of the top of the cap 24 when the cap 24 is securely attached to the housing 12 in order to form a seal between the cap 24 and the housing 12. The wiper seal 58 is formed of an elastic material, such as SANTOPRENE. The annular wiper seal 58 can be carried by the cap 24, either by being adhesively attached, co-molded or simply held in place by frictional engagement with adjacent surfaces of the cap 24.

Turning now to details of the riser 14, the riser 14 is a generally tubular component with an open upper end and an open lower end with a fluid passage therebetween, as illustrated in FIGS. 3 and 4. The fluid passage permits fluid from the interior of the housing 12 to exit the housing 12 through the riser 14 and ultimately through the nozzle body 16 attached to the upper end of the riser 14. The majority of the riser 14 has a first outer diameter and a first inner diameter. However, there are different diameters adjacent the each of the upper end and lower end of the riser 14, as explained in greater detail below.

Figure 6:
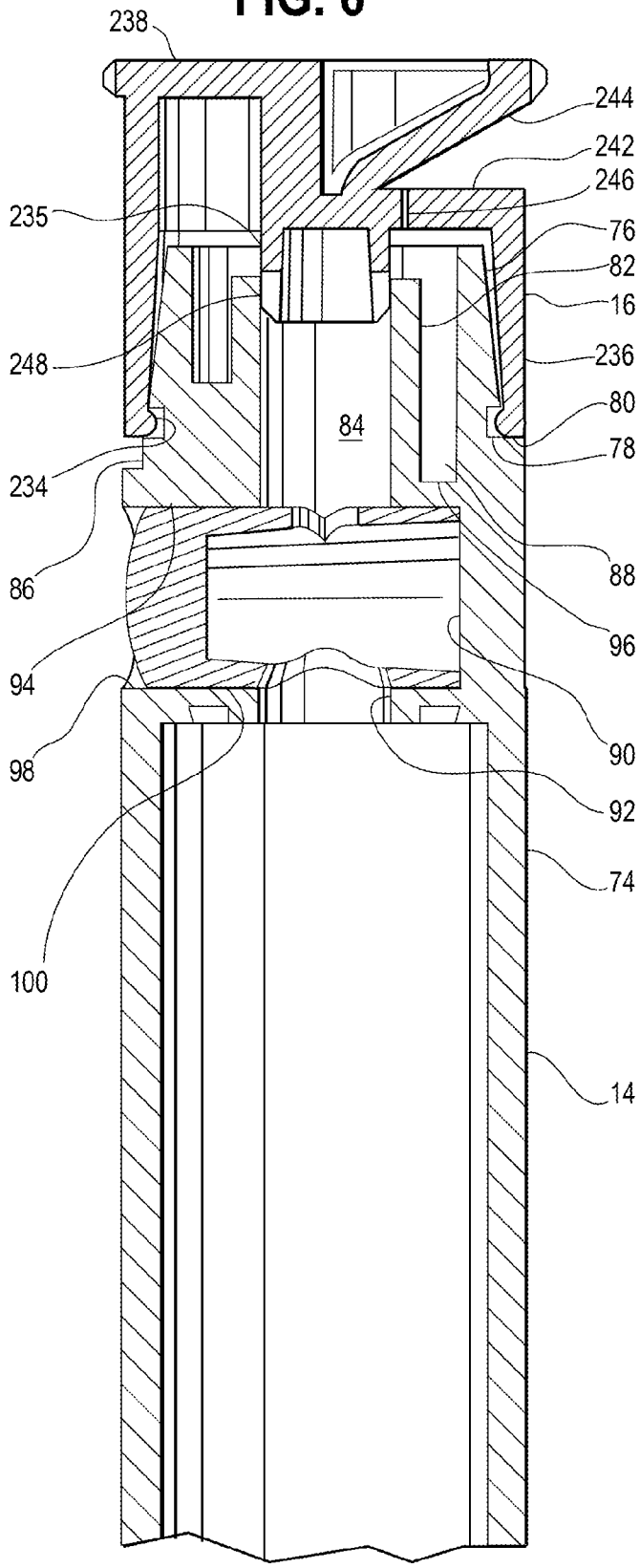
FIG. 6 is a section view of an end portion of the riser and the attached nozzle of FIG. 1 taken along line VI-VI of FIG. 1.
Figure 7:
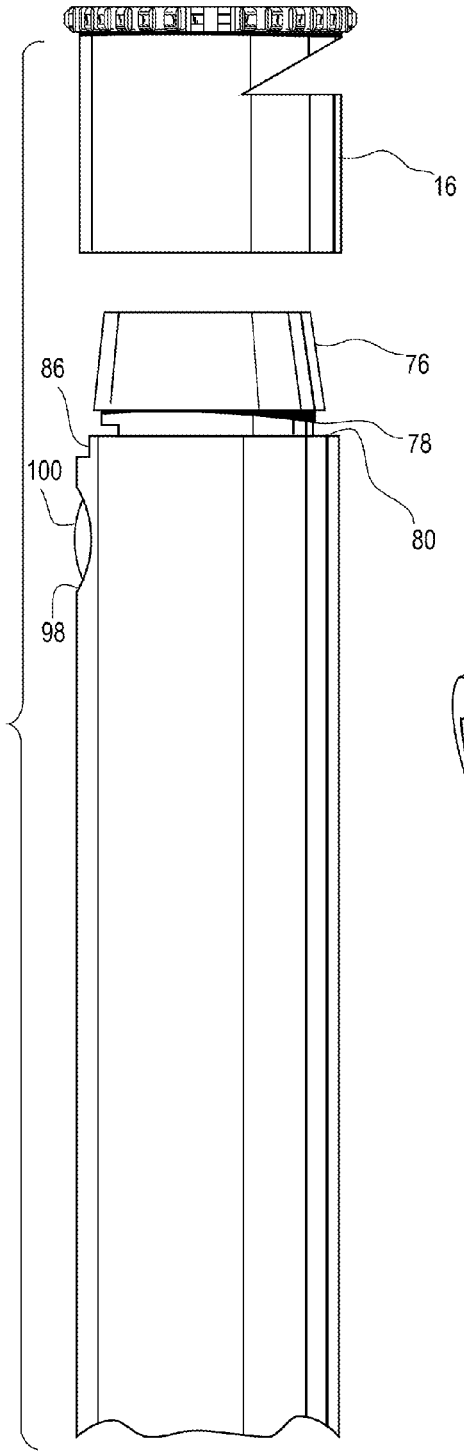
FIG. 7 is an exploded view of the nozzle and end portion of the riser and nozzle of FIG. 1.

With reference to FIGS. 6 and 7, adjacent the upper end of the riser 14 is a tapered wall 76 narrowing toward the uppermost extent of the riser 14. This tapered wall 76 has a maximum diameter that is less than the first outer diameter, as well as a generally constant inner diameter that is less than the first inner diameter. An upper step 80 is formed at the intersection of the maximum diameter of the tapered wall 76 and the first outer diameter of the riser 14. Coextensive with the step 80 is an inwardly-extending, circumferential groove 78. The groove 78 is dimensioned to at least partially receive an inwardly-extending, annular protuberance 234 of the outer skirt 236 of the nozzle body 16 in order to removably secure the nozzle body 16 to the upper end of the riser 14 using a snap-fit.

The purpose of the tapered wall 76 is to urge the lower end of the outer skirt 236 of the nozzle body 16 outwardly until the protuberance is radially aligned with the groove 78 and can snap into place in the groove 78. To facilitate detachment of the nozzle body 16 from the riser 14, an external slot 86 may be provided in the riser 14. The bottom of the slot 86 includes an inwardly-extending wall of the riser 14, below the step 80, while the top of the slot 86 is exposed to an end of an outer skirt 236 of the nozzle body 16 (which we be described in greater detail below). This permits a tip of a pry tool, such as a flat blade screwdriver or the like, to be inserted into the slot 86 to pry the end of the outer skirt 236 outwardly away from the riser 14, and hence the adjacent portion of the protuberance 234 out of engagement with the groove 78, to permit the nozzle body 16 to be moved upwardly past the maximum diameter of the tapered wall 76 and off of the upper end of the riser 14.

Spaced radially inward from the tapered wall 76 is an upstanding inner wall 82 having an outlet fluid passage 84 extending therethrough. The inner wall 82 has a height that is less than the height of the surrounding tapered wall 76, and is configured to mate with part of the nozzle body 16, as will be described in greater detail, to form a fluid chamber 88 between the nozzle body 16, the outer diameter of the inner wall 82, and the inner diameter of the tapered wall 76, as well as an upper intermediate wall 96 of the riser 16 extending between the lower extent of the inner wall 82 and the adjacent portion of the tapered wall 76.

A valve, in the exemplary embodiment a plug valve 100, is disposed within the riser 16 upstream of the nozzle body 16, as illustrated in FIGS. 3, 4 and 6 in order to control fluid flow through the riser 14 and, specifically, from the lower end of the riser 14 to the upper end of the riser 14 and hence the nozzle body 16 thereon. The plug valve 100 is accessible through an opening 98 is the side of the riser 14, and is rotatable to vary the amount of fluid flowing through the riser 14 and to the nozzle body 16. The plug valve 100 is recessed within the opening 98 of the riser 14 such that the valve 100 does not interfere with the movement of the riser 14 between its extended and retracted positions.

Figure 19:
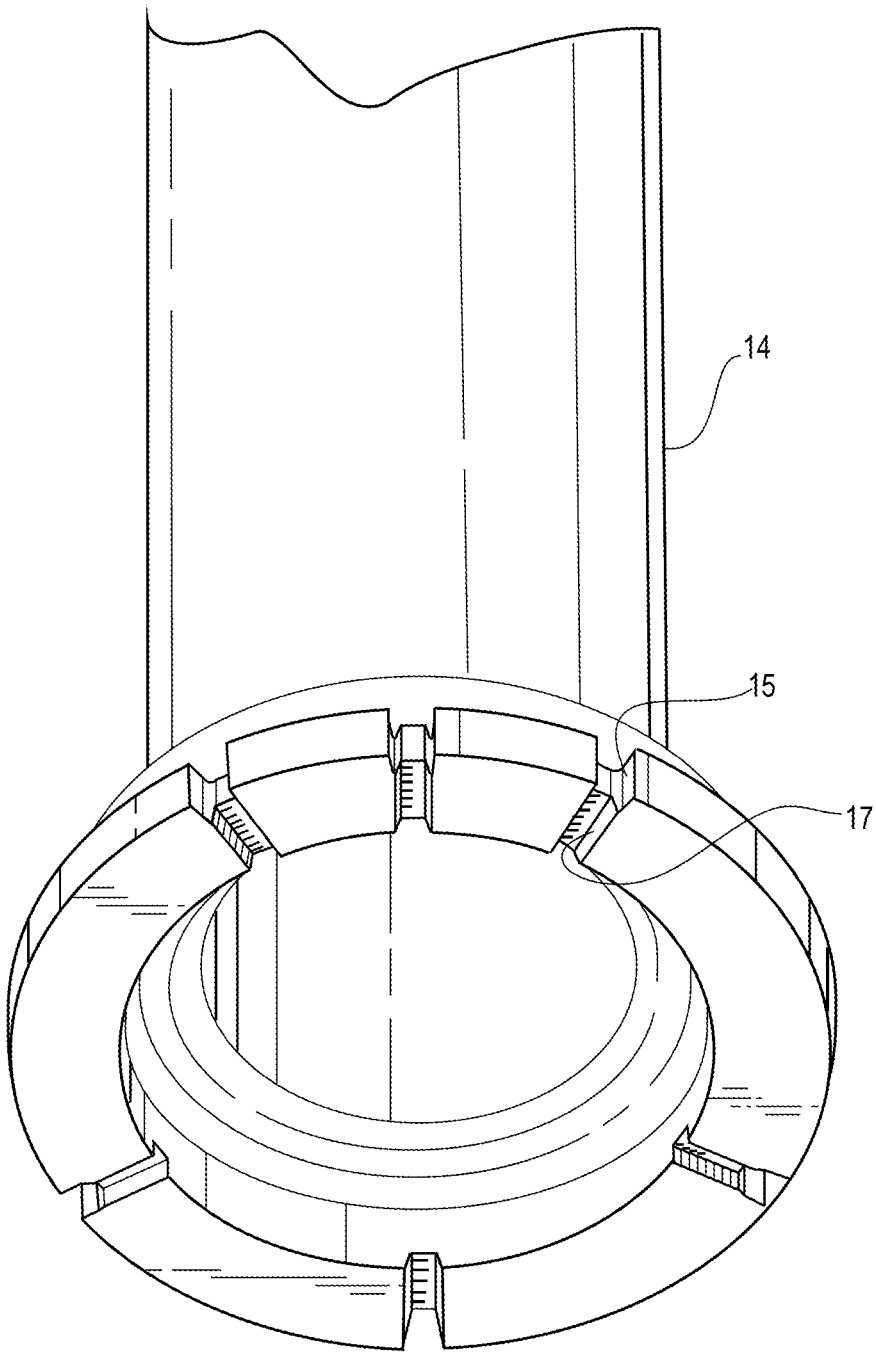
FIG. 19 is a detailed view of an alternative bottom end of the riser.

The riser 14 may optionally be keyed to the housing 12 such that rotation between the two is limited. This can advantageously permit the plug valve 100 to be orientated to be accessible from consistent side of the housing 12. An indicator, such as text and/or an arrow, can be attached to or integrally formed with the housing 12 to indicate the location of the plug valve 100, particularly useful when the riser 14 is retracted. To limit rotation between the riser 14 and the housing 12, the lower end of the riser 14 can have one or more radially-outward extending, longitudinally-orientated slots 15, as illustrated in FIG. 19. A corresponding number of longitudinally-extending, radially-inward protruding ribs 11 can be formed on the inner portion of the sidewall of the housing 12, as illustrated in FIGS. 3 and 5. The ribs 11 of the housing 12 can mate with the slots 15 of the riser 14 to limit relative rotation therebetween. Furthermore, the position and number of the ribs 11 and slots 15 can be selected so that the riser 14 will fit into the housing 12 with only one predetermined orientation, which can be used to align the plug valve 100, such as in an asymmetrical arrangement. For example, three closely spaced slots 15 can be arranged on one side of the bottom portion of the riser 14, and three widely spaced slots 15 can be arranged on the opposite side of the bottom portion of the riser 14, along with similarly spaced, cooperating ribs 11 in the housing 12. Also as illustrated in FIG. 19, each of the slots 15 at the bottom of the riser 14 can be aligned with radially-extending slots 17. The radially-extending slots 17 can facilitate fluid flow to the interior of the riser 14, such as when the bottom of the riser 14 is abutting the bottom of the interior of the housing 12.

Figure 8:
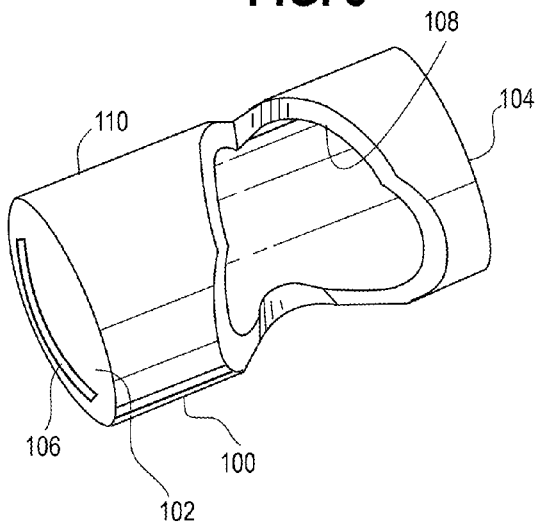
FIG. 8 is a perspective view of a plug valve of the riser of the pop-up irrigation device of FIG. 1 rotatable to adjust the flow through the riser to the attached nozzle.

The plug valve 100 is cylindrical, having a sidewall 110, a closed end 102 and an opposite open end 104, as illustrated in FIGS. 6 and 8. The plug valve 100 has a flow port 108 in the sidewall 110 that is tapered in size from wide to narrow. The closed end 102 has an actuator formed on the exterior thereof in order to facilitate rotation of the actuator, such as by using a tool. In the exemplary embodiment, the actuator is a slot 106 configured to receive the end of a tool, such as a flat blade screwdriver.

The plug valve 100 is seated in a chamber having a surrounding cylindrical wall 94 integrally formed in the riser 14, which chamber has a closed end 90 opposite the opening 98 extending through the side of the riser 14, as illustrated in FIG. 6. The lower portion of the chamber wall 94 has an inlet passage 92 and the upper portion of the chamber wall, spaced closer to the nozzle body 16 than the lower portion of the chamber wall, coincides with the outlet fluid passage 84. Rotation of the plug valve 100 can bring the flow port 108 into and out of alignment with one or both of the inlet passage 92 and the outlet fluid passage 84 of the riser 14 to control the volume of fluid flowing through the riser 14 to the nozzle body 16 in order to control the throw radius of fluid exiting the nozzle body 16. The plug valve 100 can be configured to merely block and unblock the fluid flow, as well as configured to vary the volume of the fluid flow at many different increments between fully blocked and fully unblocked. The dimensions of the inlet passage 92 of the riser 14, the outlet fluid passage 84 of the riser 14 and the flow port 108 of the valve 100 can be selected to provide for the desired range of flow rates.

In another alternative embodiment, a valve is disposed within a riser 316 and is configured to have one or more stops which limit the movement of the valve. As depicted in the exemplary embodiment of FIGS. 16-18, the valve may be a rotatable plug valve 300, similar to that described above. That is, the rotatable plug valve 300 has a cylindrical outer wall 302, a closed end 304 and an open end 306, along with an opening 308 extending through the outer wall 302 to permit fluid flow therethrough. A slot 310 for a flat head screwdriver is formed in the closed end 304 of the valve 300, and an arrow 312 or other such indicator may also be formed in the closed end 304 for use in determining the position of the valve 300 when viewed from the exterior of the riser 316.

Figure 16:
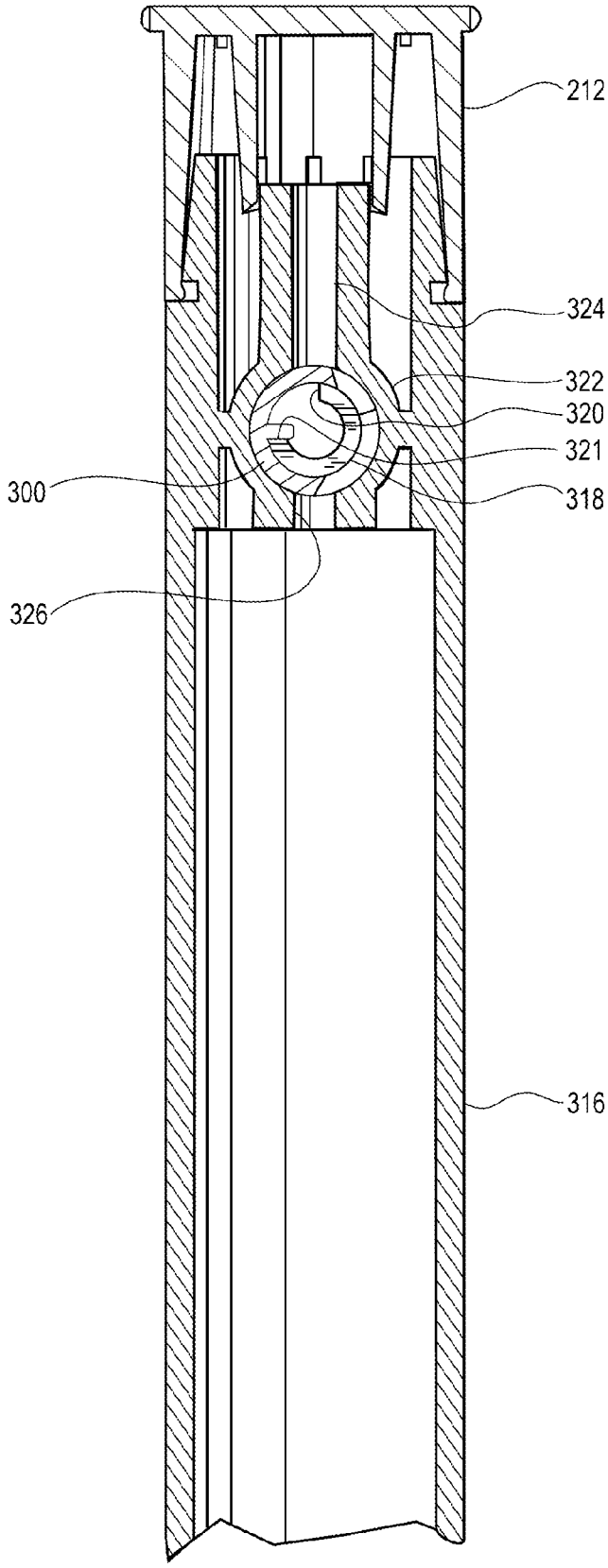
FIG. 16 is a sectional view of an end portion of an alternative riser having a nozzle attached thereto and an alternative plug valve, and taken perpendicular to an axis of rotation of the plug valve, the riser having a stop positioned to limit rotation of the plug valve.
Figure 17:
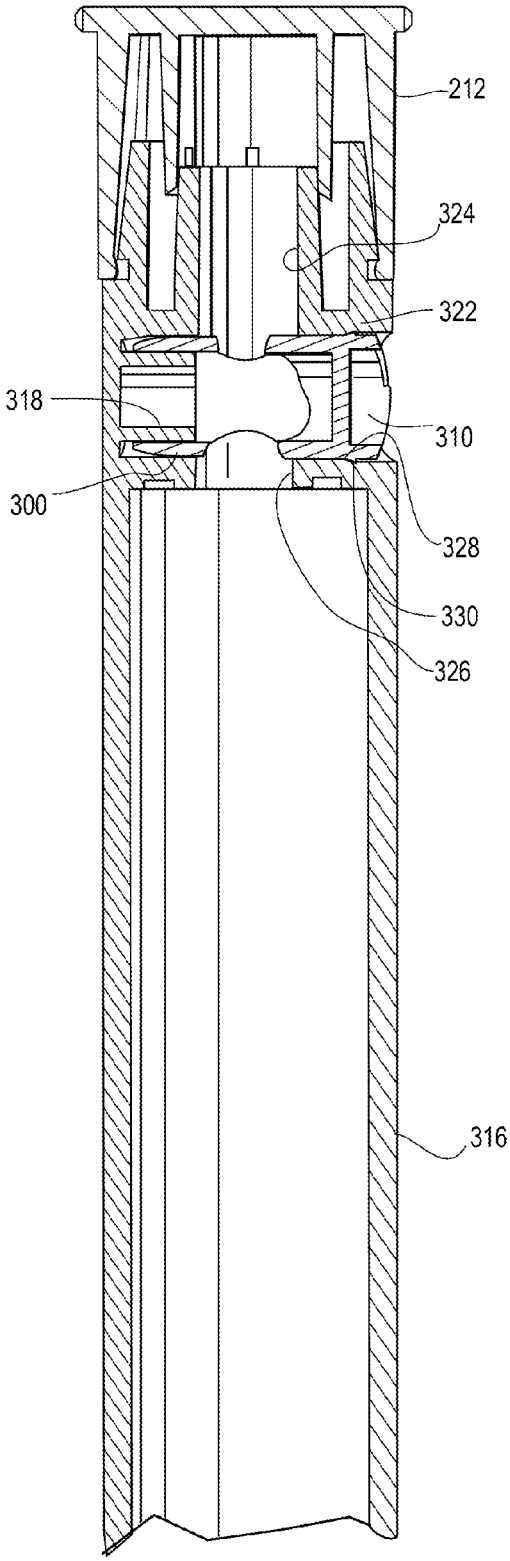
FIG. 17 is a sectional view of the end portion of the alternative riser having a nozzle attached thereto and the alternative plug valve of FIG. 16 and taken parallel to the axis of rotation of the plug valve.
Figure 18:
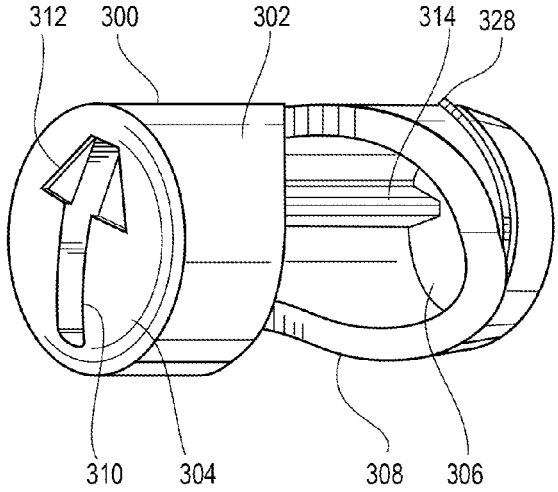
FIG. 18 is a perspective view of the alternative plug valve of FIGS. 16 and 17.

Unlike the valve 100 described in the prior embodiment, the plug valve 300 of the alternative embodiment has a longitudinally-extending, internal rib 314. The rib 314 is configured to cooperate with a stop 318 formed in the interior of the riser 316. More specifically, the stop 318 is generally C-shaped, as illustrated in FIG. 16, and extends inwardly toward the longitudinal axis of the riser 316, as illustrated in FIG. 17. The stop 318 is dimensioned to fit within the open end 306 of the plug valve 300. When the rib 314 of the plug valve 300 abuts one end 321 of the stop 318, further rotation in that direction is limited by the one end 321. When the rib of the plug valve 300 abuts the other end 320 of the stop 318, further rotation in that direction is limited by the other end 320. The rib 314 and stop 318 can be configured so that the rotation of the plug valve 300 is limited to being between fully open and fully closed, and to provide tactile feedback to a user when those positions are reached. The plug valve 300 may be supported in a seat 322 which surrounds a significant extend of the plug valve 300, and the opening 308 can be alignable with an upstream opening 326 and downstream opening 324 through the seat 322 to permit fluid flow through the riser 316. The plug valve 300 can optionally include a radially-outward barb 328 about its circumference, as illustrated in FIGS. 17 and 18. The barb 328 can be configured to made with an annular groove 330, illustrated in FIG. 17, disposed within the seat 322 for the plug valve 300 within the riser 14, and can be configured to permit insertion of the plug valve 300 into the seat 322 while restricting removal. A barb-and-groove arrangement can also be used for the aforementioned plug valve 100.

Moving in a direction toward the lower end of the riser 14 is a region with an enlarged, second inner and outer diameter and then yet another region with an even more enlarged, third inner and outer diameter. The intersection of the first outer diameter and the second outer diameter creates a perpendicularly extending first step 50. The intersection of the second outer diameter and the third outer diameter creates a perpendicularly extending second step 46. The first step 50 is positioned to be engaged by the depending portion of the body 62 of the wiper seal 58 when the riser 14 is at its maximum extension from the interior of the housing 12 in order to form a seal therewith, as illustrated in FIG. 5, further restricting water from exiting through the open upper end 22 of the housing 12 other than via the riser 14. The second step 46 is positioned to be engaged by a lower end 48 of the spring 44 for biasing the riser 44 to its fully retracted position.

Figure 12:
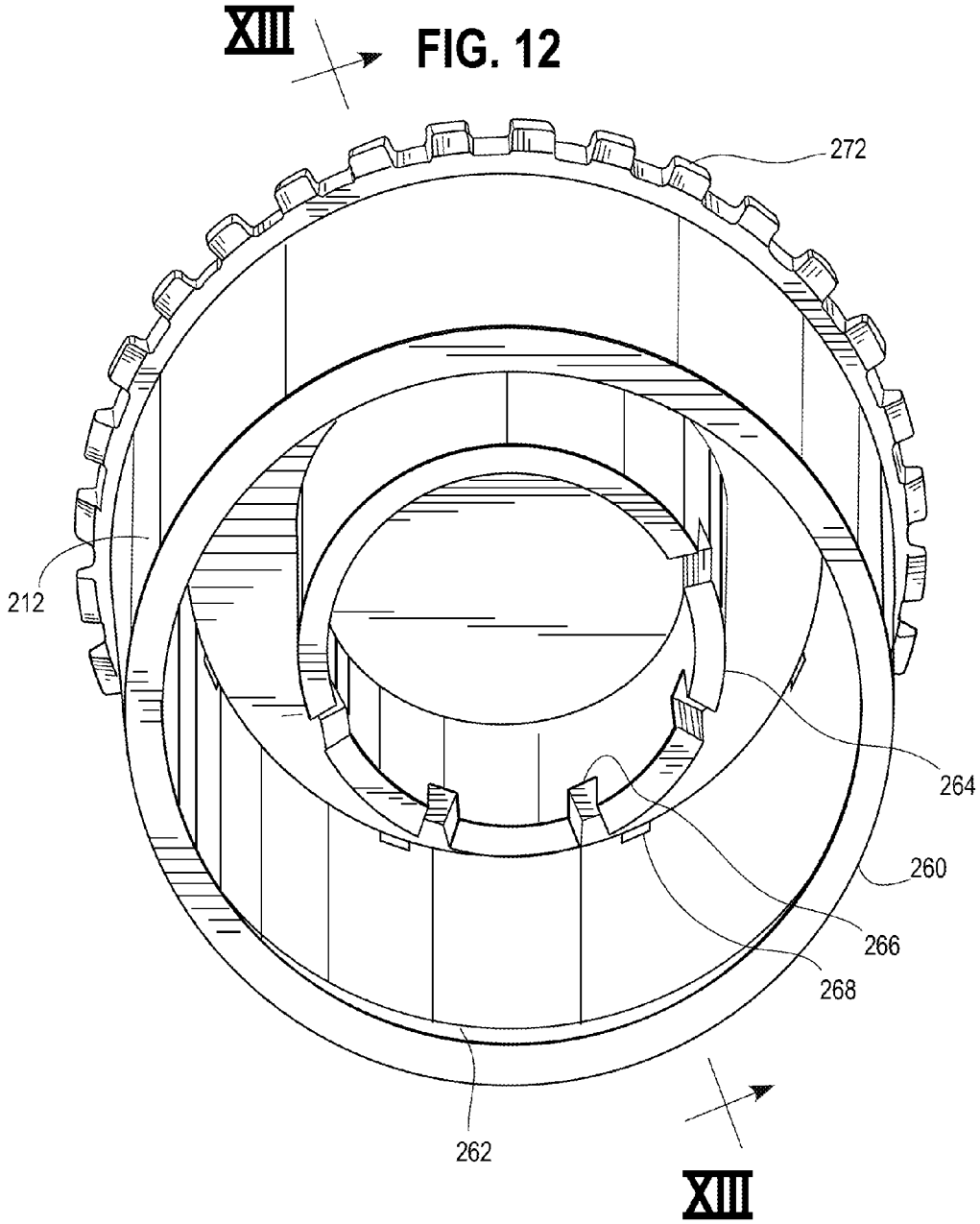
FIG. 12 is a bottom perspective view of one of the nozzles of the nozzle bush of FIG. 9.
Figure 13:
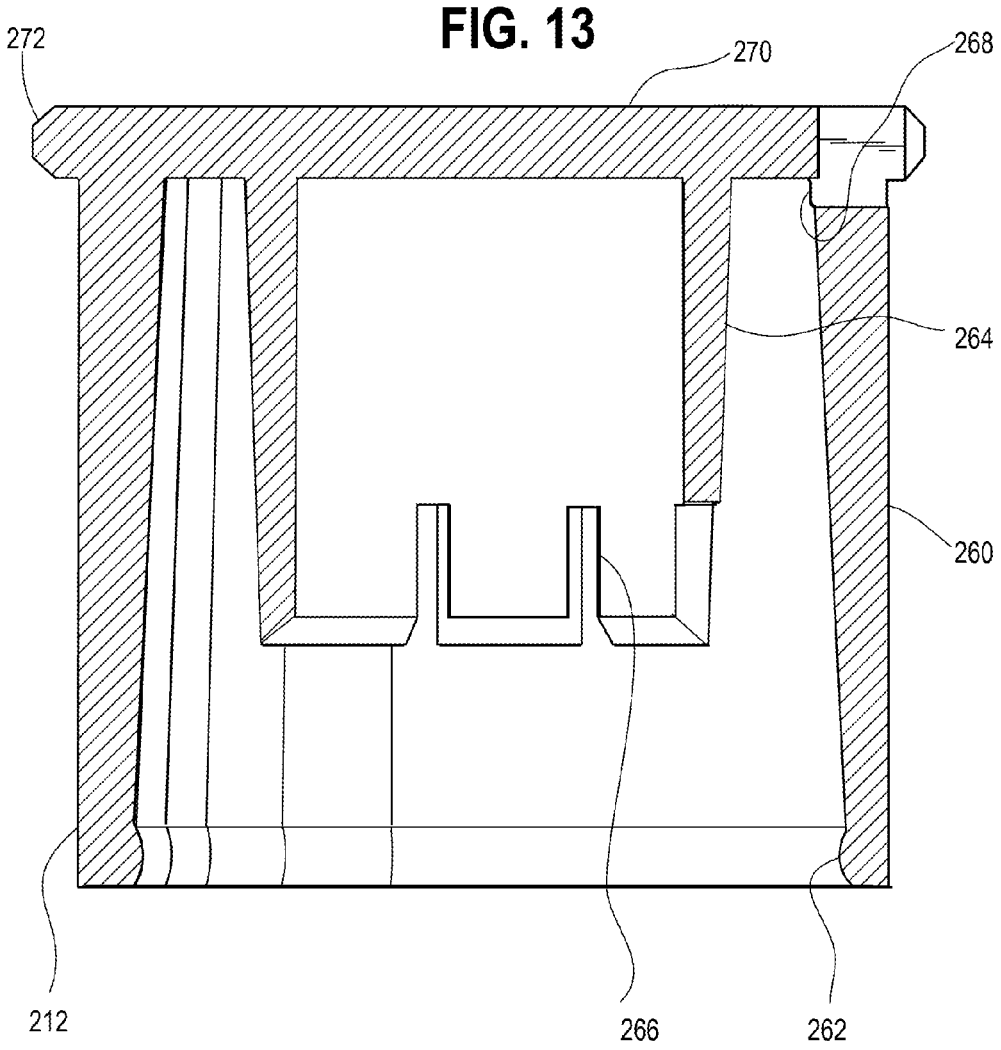
FIG. 13 is a sectional view of the nozzle of FIG. 12 taken from line XIII-XIII of FIG. 11.
Figure 14:
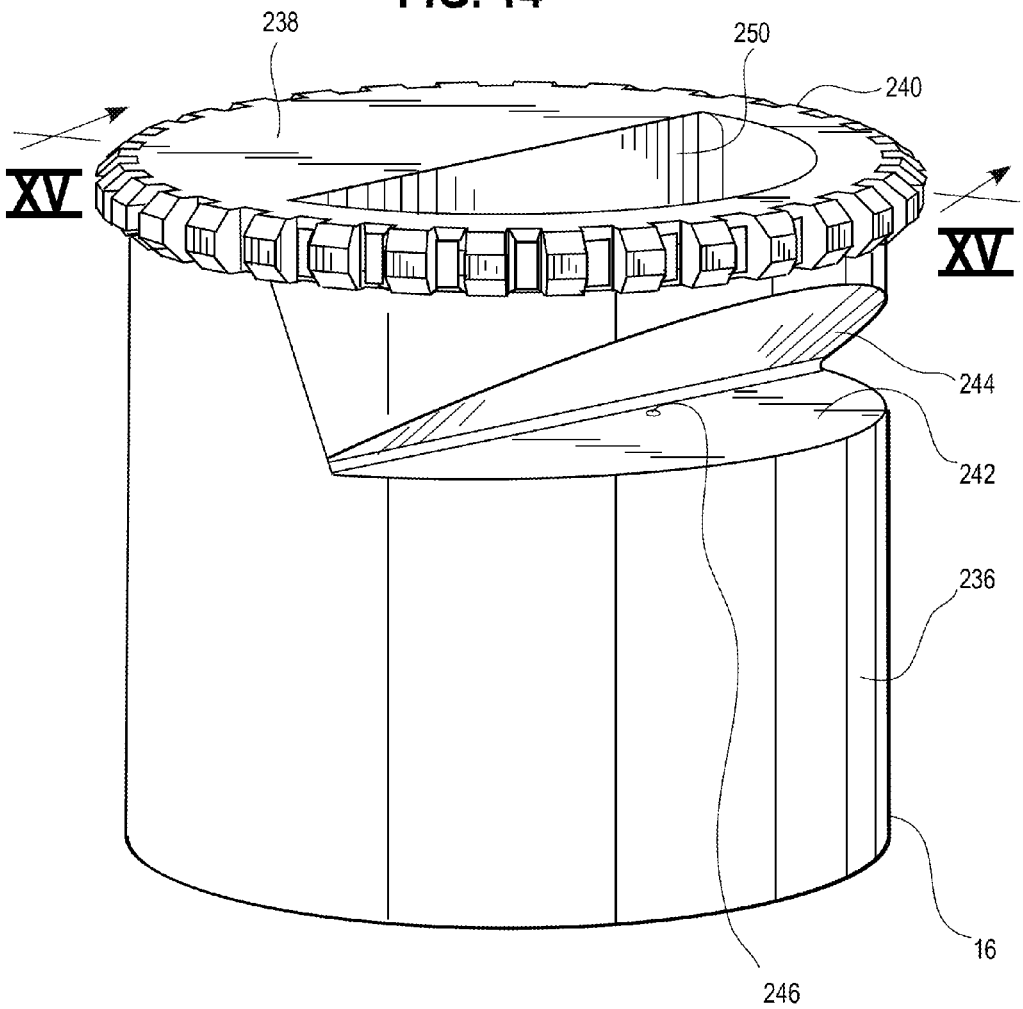
FIG. 14 is a front perspective view of another of the nozzles of the nozzle bush of FIG. 8.
Figure 15:
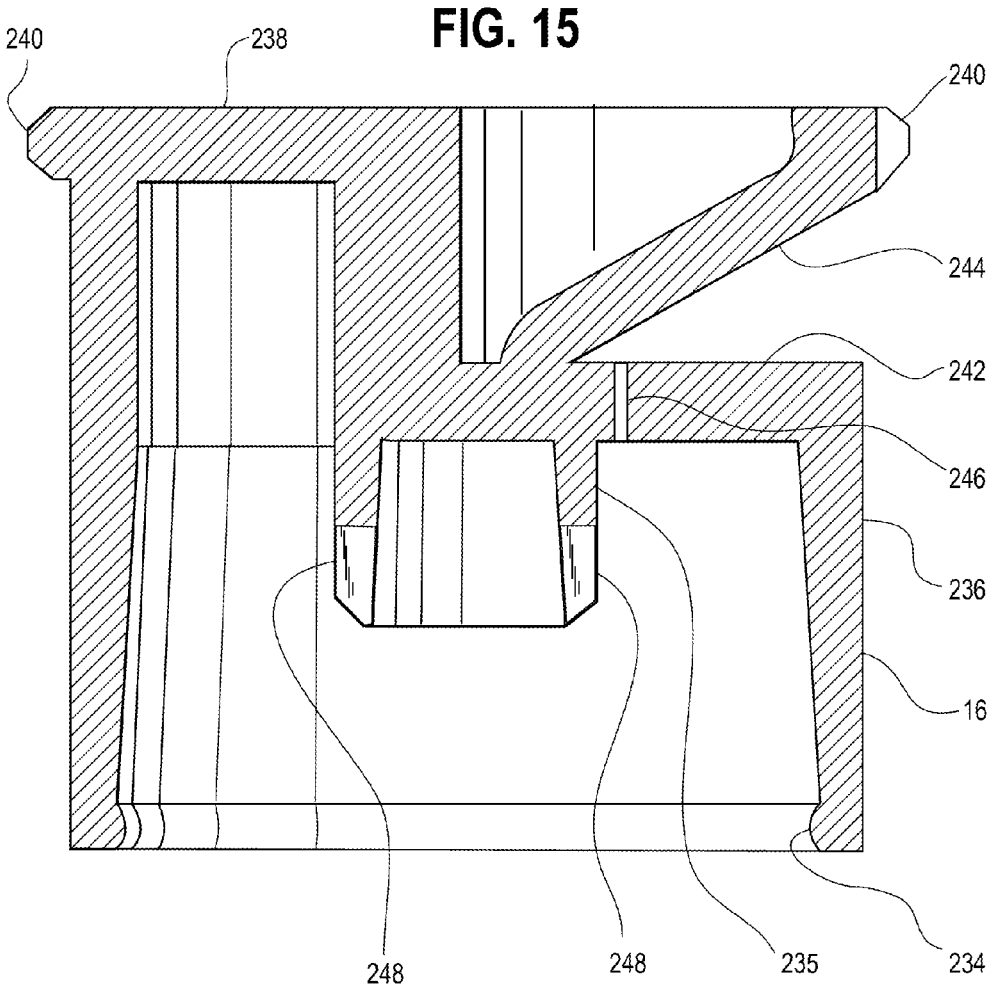
FIG. 15 is a sectional view of the nozzle of FIG. 14 taken from line XV-XV of FIG. 14.

Nozzle bodies having different configurations can be selectively attached to the riser. A first type of nozzle body can be configured to discharge irrigation water in a spray pattern, an example of which is illustrated in FIGS. 14 and 15. The geometry of the nozzle body can control the arcuate extent of the spray pattern, as will be discussed in greater detail below. For example, the nozzle body can be configured to have a spray pattern with an arcuate extent of 90 degrees, 180 degrees or about 360 degrees. As second type of nozzle body can be configured to discharge irrigation water in a stream pattern through one or more openings, an example of which is illustrated in FIGS. 12 and 13. The number of openings and their spacing can vary depending upon the desired arcuate extent of the stream pattern, as will be discussed in greater detail below. For example, the nozzle body can be configured to have a stream pattern with an arcuate extent of 90 degrees, 180 degrees or about 360 degrees.

With reference to an example of the first type of nozzle body, and equally applicable to the second type of nozzle body, the nozzle body 16 has a top 238 with a depending outer skirt 236, as illustrated in FIGS. 14 and 15. The end of the outer skirt 236, opposite the top 238, has a radially-inward extending protuberance 234 that is configured to be at least partially received with the radially-outward facing groove 78 extending about the circumference of the upper portion of the riser 14. The protuberance 234 on the outer skirt 236 of the nozzle body 16 is designed to snap into the groove 78 of the riser 14, as illustrated in FIG. 6. This type of attachment between the nozzle body 16 and the riser 14 eliminates the need for internal and external threading arrangements, thereby advantageously providing cost savings as well as simplified attachment and detachment of the nozzle body 16 from the riser 14.

Moreover, the snap arrangement can be configured to advantageously permit the nozzle body 16 to be rotated when it is attached to the riser 14, thereby facilitating adjustments to the direction of the emitted spray or stream and permitting the spray or stream to be directed away from a user during installation or adjustments. The riser 14 and nozzle body 16 can be configured to permit nozzle body 16 rotation a full 360 degrees, or less if desired. In one aspect, the nozzle body 16 can be configured to rotate relative to the riser 14 when attached thereto at least 90 degrees, 180 degrees or greater up to a full 360 degrees, preferably without requiring moving in the axial direction of the riser 14, such as would be required with a threaded attachment.

Disposed radially inward from the outer skirt 236 is a depending inner skirt 235. The inner skirt 235 has a length less than the length of the outer skirt 236 such that it is recessed within the outer skirt 236. When attached to the riser 14, the outer side of the inner skirt 236 can engage the inner side of the upstanding inner wall 82 of the upper end of the riser 14, as discussed above. Conversely, the relative positions of the inner skirt 235 of the nozzle body 16 and the inner wall 82 of the riser 14 can be reversed. The lower edge of the inner skirt 235 of the nozzle body 16 can have a plurality of different slots 248 formed therein and extending to the edge of the skirt 235. The one or more slots 248 provide for a restricted or metered fluid communication from outlet fluid passage 84 of the riser 14 to the fluid chamber 88 disposed between the inner and outer walls 82 and 76 of the upper end of the riser 14, as illustrated in FIG. 6. From the fluid chamber 88, fluid can exit the nozzle body 16 through the one or more orifices 246 thereof. The purpose of the slots 248 is to provide for a pressure drop in the irrigation fluid upstream of the orifice 246 in the nozzle body 16, thereby advantageously permitting a higher pressure of irrigation fluid to be supplied to the irrigation device 10. The number and size of the slots 248, as well as their open area when engaged with the upstanding inner wall 82 of the riser 14, can be selected to provide for a desired pressure drop. Furthermore, the number and size of the orifices 246 can be selected to provide for a further pressure drop. Thus, varying the number and size of the slots 248 and orifices 246 can together be utilized to achieve a desired pressure drop.

Turning first to details of an exemplary embodiment of the first type of nozzle body 16 configured to emit a spray pattern, depicted in FIGS. 14 and 15, the nozzle body 16 includes the outer skirt 236 with inwardly-facing protuberance 234, inner skirt 235 with slots 248 and top wall 238 that have been referenced above. Disposed about the periphery of the top 238 are a plurality of radially-extending teeth 240, which can provide for improved gripping as opposed to a smooth periphery of the top 238. The orifice 246 extends through an intermediate wall 242 which extends generally perpendicular to a longitudinal axis of the nozzle body 16. The upstream end of the orifice 246 is in fluid communication with the fluid chamber 88 disposed between the inner and outer walls of the upper end of the riser 14. The downstream end of the orifice 246 is orientated to direct the exiting fluid jet against an inclined deflector 244, which in turn breaks up the fluid jet and deflects the jet outwardly from the mouth created in the outer skirt 236 of the nozzle body 16 between the deflector 244 and the intermediate wall 242 and away from the device to irrigate the surrounding terrain.

Figure 9:
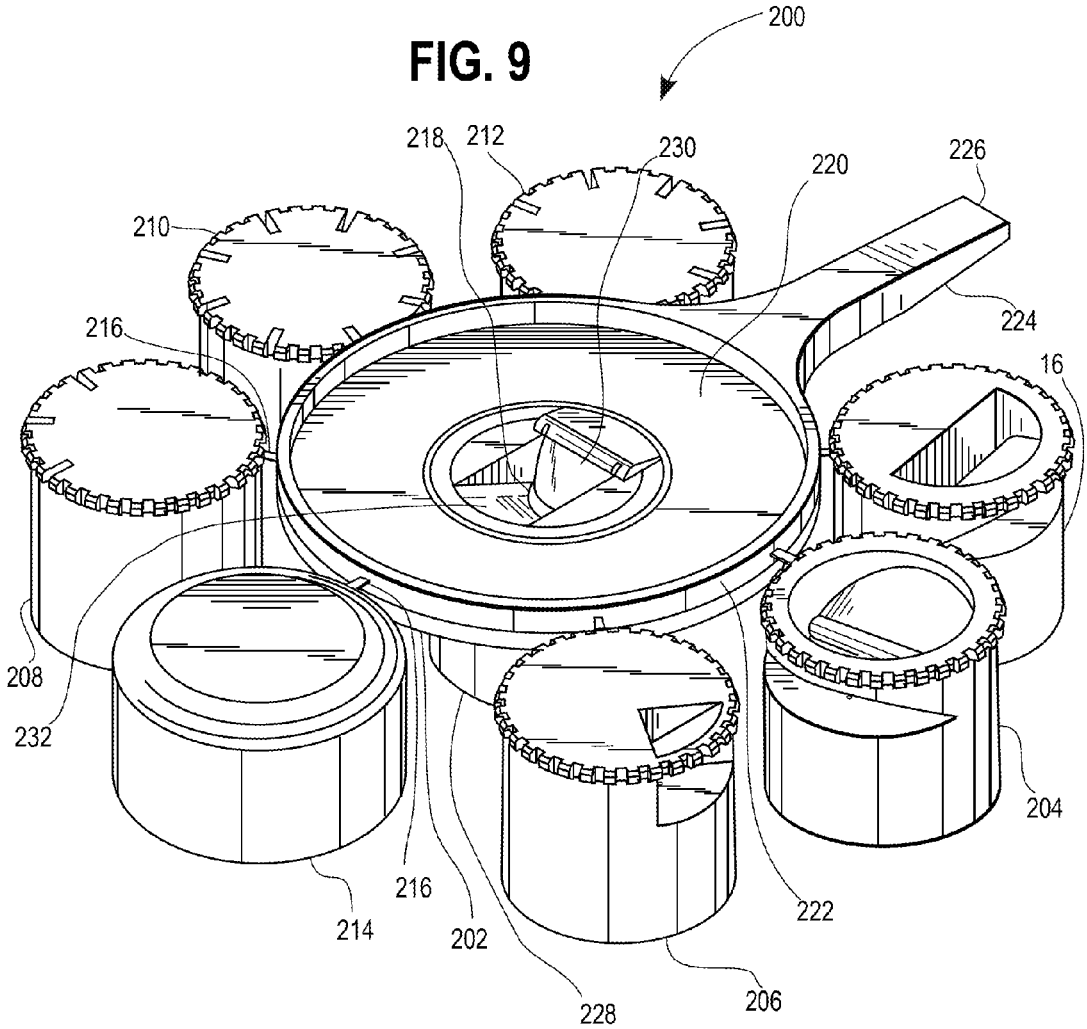
FIG. 9 is a perspective view of a nozzle bush having a plurality of nozzles disposed about its perimeter, the nozzles being attachable to the riser of the pop-up irrigation device of FIG. 1.
Figure 10:
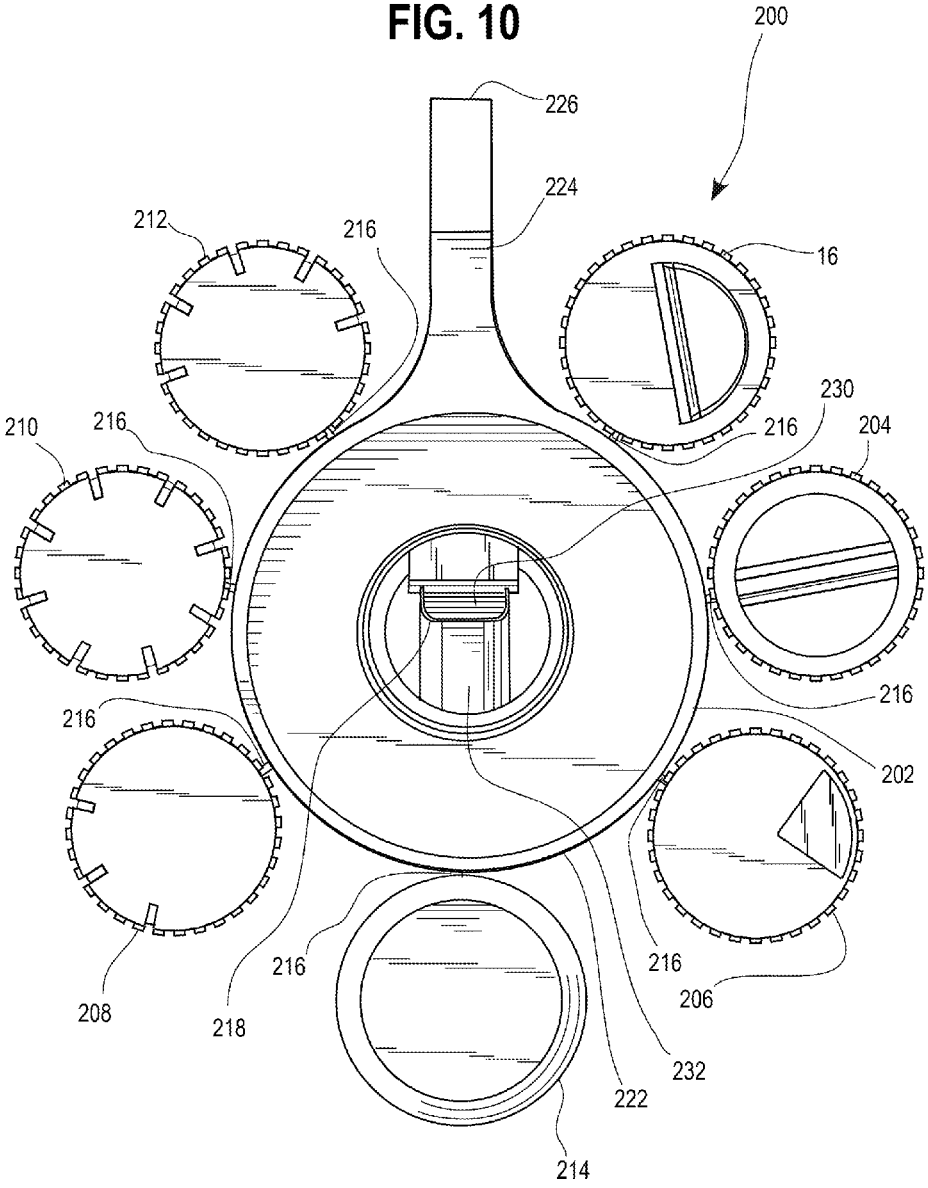
FIG. 10 is top plan view of the nozzle bush of FIG. 9 showing the top sides of the nozzles.
Figure 11:
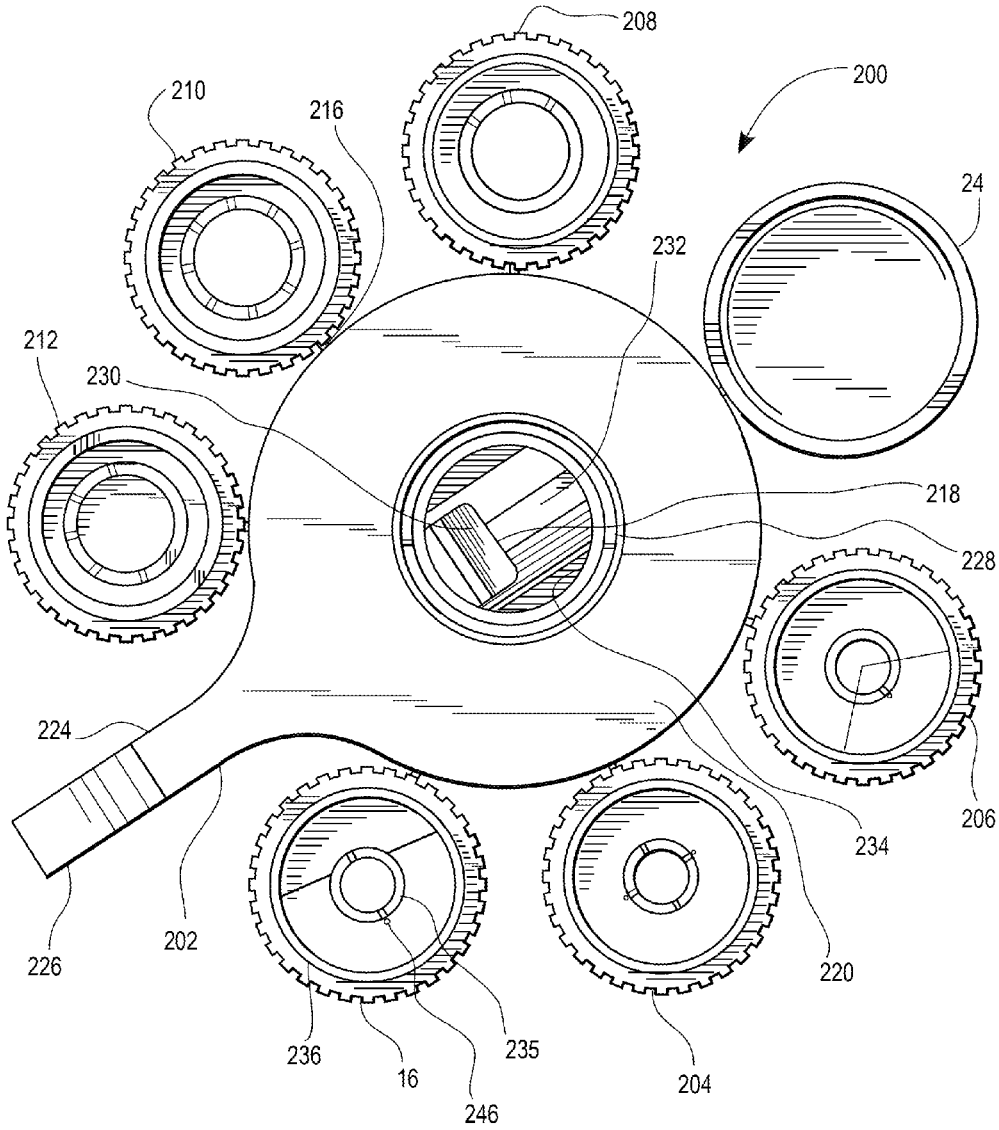
FIG. 11 is a bottom plan view of the nozzle bush of FIG. 9 showing the undersides of the nozzles.

In the embodiment of FIGS. 14 and 15, the mouth extends about 180 degrees of the nozzle body 16, thereby creating a semicircular spray pattern. Other configurations of the spray pattern can be achieved using different nozzle body geometries, and are illustrated in FIGS. 9-11. For example, a quarter-circle spray pattern can be achieved using a nozzle body 206 having a mouth that extends about 90 degrees of the nozzle body 206. A full-circle spray pattern can be achieved using a nozzle body 204 having one mouth that extends about 180 degrees of the nozzle body 204 and a second mouth that also extends about 180 degrees of the nozzle body 204, each with their own orifice, thereby effectively combining a pair of about 180 degree mouths onto a single nozzle body 204. Other arcuate spray patterns can be achieved by adjusting the arcuate extent to which the mouth extends of the nozzle body. Furthermore, the number of orifices and their sizes feeding each mouth can vary depending upon the desired spray pattern.

Turning next to details of an exemplary embodiment of the second type of nozzle body 212 configured to emit a stream pattern, depicted in FIGS. 12 and 13, the nozzle body 212 includes an outer skirt 260 with an inwardly-facing protuberance 262, an inner skirt 264 with slots 266 and a top 270 similar to those referenced above with respect to the nozzle body 16 of the first type. Also similar, disposed about the periphery of the top 270 are a plurality of radially-extending teeth 272. However, instead, of having the aforementioned mouth formed between the deflector 244 and intermediate wall 242 fed by an orifice 246, one or more orifices 268 (in the illustrated embodiment, five orifices) extend through the sidewall 260 and/or top wall 270 of the nozzle body 212. The orifices 268 in the illustrated embodiment are formed at the intersection of the sidewall 260 and top wall 270 and are generally rectangular, although other locations and shapes of the orifices 268 can be suitable. The edges defining the orifices 268 can be shaped or tapered to further shape the exiting stream of irrigation fluid. Also, the inner skirt 264 of the nozzle body 212 configured for emitting streams can be dimensioned for engaging the outer diameter of the inner wall 82 of the riser 14, as opposed to the inner diameter of the inner wall 82 of the riser 14 as in the case of the inner skirt 235 of the aforementioned nozzle body 16 configured for emitting a spray. However, either nozzle body type could be adapted to have the inner skirt engage either the inner or outer diameter of the inner wall 82 of the riser 14.

In the embodiment of FIGS. 12 and 13, the five orifices 268 are equally spaced about 180 degrees around the circumference of the nozzle body 212, thereby creating a semicircular stream pattern. Other configurations of the stream pattern can be achieved using different nozzle body geometries, and are illustrated in FIGS. 9-11. For example, a quarter-circle stream pattern can be achieved using a nozzle body 208 having three equally spaced orifices that extend about 90 degrees around the circumference of the nozzle body 208. A full-circle stream pattern can be achieved using a nozzle body 210 having eight equally spaced orifices that extend 360 degrees around the circumference of the nozzle body 210. Other arcuate stream patterns can be achieved by adjusting the arcuate extent, spacing, size and number of orifices.

Figure 20:
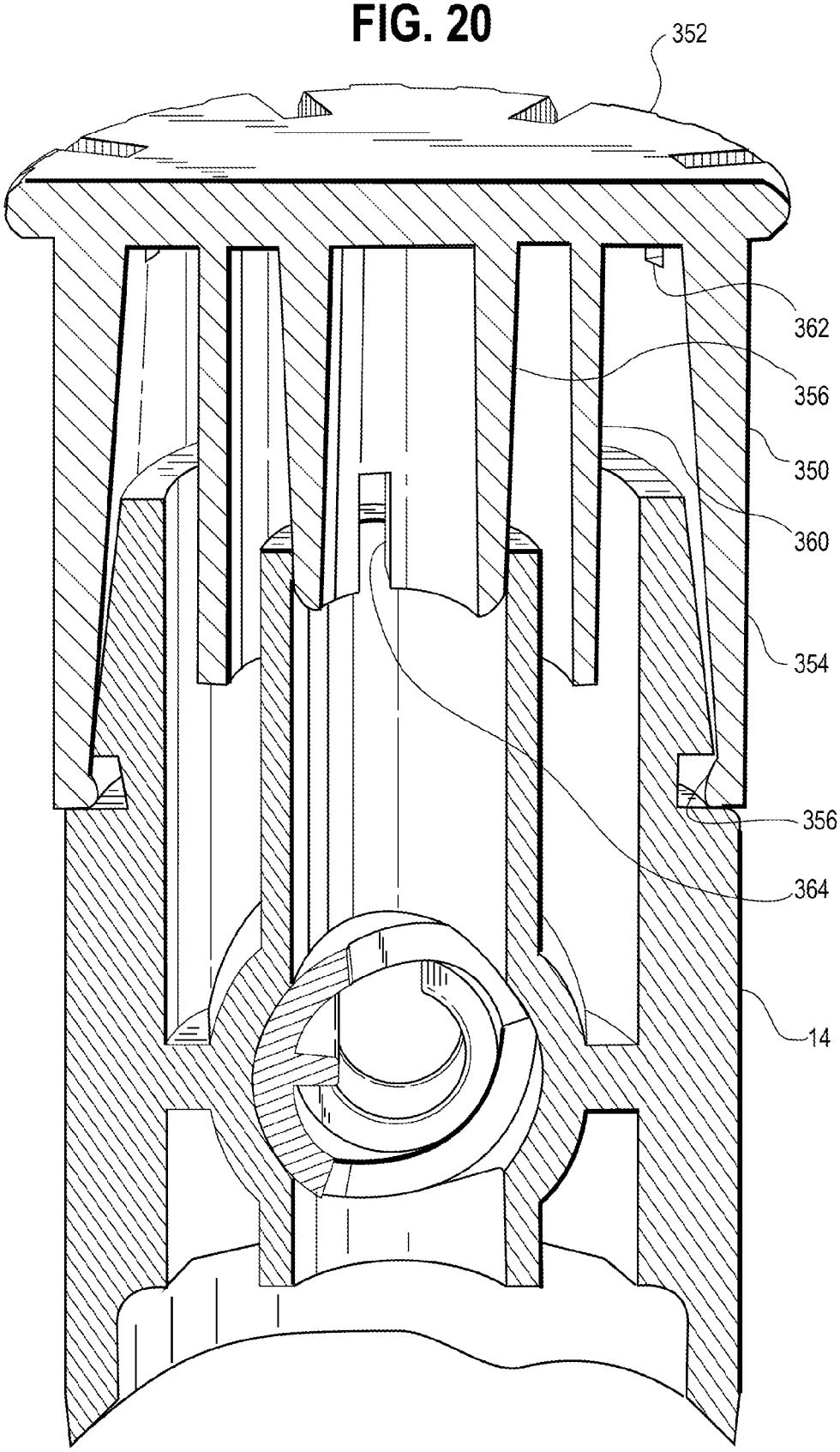
FIG. 20 is a detailed sectional view of an alternative nozzle body attached to an end of the riser.
Figure 21:
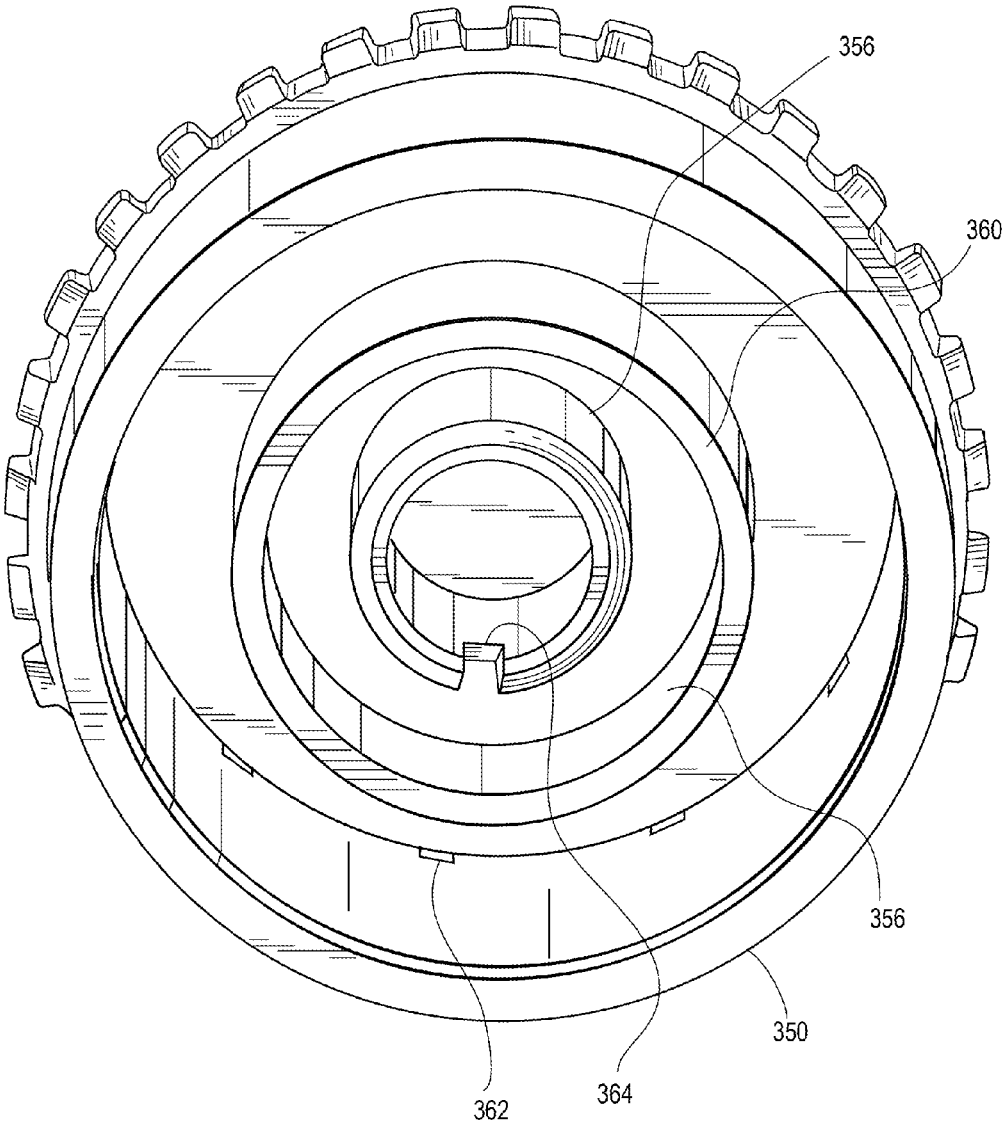
FIG. 21 is a perspective view of the bottom of the alternative nozzle body of FIG. 20.

In an alternative nozzle body 350, illustrated in FIGS. 20 and 21, an intermediate skirt 360 is positioned between an inner skirt 356 and an outer skirt 354. The intermediate skirt 360 creates a more circuitous flow path for the fluid exiting the riser 14 to facilitate more uniform velocities of fluid exiting orifices 362 of the nozzle body 350. More specifically, and similar to the aforementioned nozzle bodies, the nozzle body 350 with the more circuitous flow path includes a top 352 with the outer skirt 354 depending therefrom. The lower end portion of the outer skirt 354 includes a radially-inward extending protuberance 356 for engaging with a circumferential groove 78 of the riser 14 to secure the nozzle body 350 in a removable, snap-on type arrangement. A depending inner skirt 356 can mate with either the inner diameter or the outer diameter of the inner wall 82 of the riser 14. The inner skirt 356 includes one or more slots 364 through which fluid can pass to the region between the inner skirt 356 and the outer skirt 354 before exiting through the orifices 362 in the outer skirt 354. In order to create a more circuitous path for the fluid, the intermediate skirt 360 depends from the top 352 and is positioned between the inner skirt 356 and the outer skirt 354. When attached to the riser 14, the intermediate skirt 360 is positioned between the outer diameter of the inner wall 82 of the riser 14 and the inner diameter of the tapered portion 76 of the riser 14, as illustrated in FIG. 20, and has a length extending below the slot 364. Thus, fluid exiting through the slot 364 of the inner skirt 356 must go generally radially outward, axially downward, around the end of the intermediate skirt 360, then axially upward before exiting through the orifices 362. A similar type of intermediate skirt 360 can be utilized in any of the foregoing nozzle bodies, as well as in the below-described nozzle bush 200. As described above, the number of the slots and orifices can be selected to provide for a pressure drop, as well as for desired exit velocities of the streams. By way of example, there may be one slot and five orifices for irrigating about 180 degrees. To irrigate about 90 degrees, there may be one smaller slot and three smaller orifices. To irrigate about 360 degrees, there may be two to four slots and eight orifices. However, any suitable number and sizes of orifices and slots may be utilized to achieve the desired irrigation pattern.

The different nozzle bodies 16, 204, 206, 208, 210 and 212 can be provided as part of a nozzle bush 200, as illustrated in FIGS. 9-11. The nozzle bush 200 includes a carrier 202 with each of the nozzle bodies 16, 204, 206, 208, 210 and 212 attached about its periphery via breakable bridges 216. The nozzle bush 200 is preferably formed of injection molded plastic. The carrier 202 includes a circular, generally planar central portion 220 having an upstanding peripheral rim 222. An optional protruding tool 224 can extend radially outward from the carrier 202. The tool 224 can have a pry bar 226 formed at an end thereof, such as for use in insertion into the slot 86 of the riser 14 for removal of an attached nozzle body 16, as discussed above. Other types of tools can also be provided on the bush 200. In addition, a cap 214 for attachment to one of the connection ports 30 can be attached by a bridge 216 to the periphery of the carrier 202.

Disposed in the center of the central portion 220 of the carrier 202 is a flush port 218. The flush port 218 is designed to be used during the flushing of the irrigation device 10. More specifically, a depending skirt 228 with an inwardly-facing annular protuberance 234 of the carrier 202 can be attached to the upper end portion of the riser 14 in the same manner as the aforementioned nozzle body 16, thereby attaching the carrier 202 to the riser 14 of the irrigation device 10. That is, the minimum inner diameter of the protuberance 234 of the skirt 228 associated with the flush port 218 of the nozzle bush 200 is substantially the same as that of the protuberance of the 234 of the outer skirt 236 of the nozzle body 216. A pair of walls 230 and 232 are inclined inwardly into the interior of the skirt 228 and have spaced free ends which at least partially define the flush port 218 therebetween. The inclined walls 230 and 232 cooperate to laterally deflect fluid exiting the riser through the flush port 218. This can permit a user to flush the irrigation device 10 without being in the path of the flushing stream, e.g., by standing on an opposite side of the carrier 202 from the direction in which the flush port 218 is aimed.

The drawings and the foregoing descriptions are not intended to represent the only forms of the pop-up device 10 configured for use in a low-pressure irrigation system. Changes in form and in the proportion of parts, as well as the substitution of equivalents, are contemplated as circumstances may suggest or render expedient; and although specific terms have been employed, they are intended in a generic and descriptive sense only and not for the purposes of limitation.

The invention claimed is:

1. A unitary nozzle body suitable for attachment to a riser of an irrigation device, the nozzle body comprising a top, an outer skirt depending from the top, an inner skirt spaced inwardly from the outer skirt, and at least one orifice in the outer skirt dimensioned for discharging a stream of water, the outer skirt being configured to permit the nozzle body to be removably attached to a riser of an irrigation device, wherein the inner skirt has at least one opening through which water can pass to a region below the at least one orifice and between the inner skirt and the outer skirt before exiting through the at least one orifice.

2. A unitary nozzle body suitable for attachment to a riser of an irrigation device, the nozzle body comprising a top, an outer skirt depending from the top, an inner skirt spaced inwardly from the outer skirt, and at least one orifice in the outer skirt dimensioned for discharging a stream of water, the outer skirt being configured to permit the nozzle body to be removably attached to a riser of an irrigation device, wherein the inner skirt has at least one opening through which water can pass to a region between the inner skirt and the outer skirt before exiting through the at least one orifice, and wherein the opening of the inner skirt is a slot that extends to a free end of the inner skirt.

3. The unitary nozzle body of claim 2, wherein the nozzle body is configured for irrigating about 90 degrees, having one slot formed in the inner skirt and three orifices.

4. A unitary nozzle body suitable for attachment to a riser of an irrigation device, the nozzle body comprising a top, an outer skirt depending from the top, an inner skirt spaced inwardly from the outer skirt, and at least one orifice in the outer skirt dimensioned for discharging a stream of water, the outer skirt being configured to permit the nozzle body to be removably attached to a riser of an irrigation device, wherein the inner skirt has at least one opening through which water can pass to a region between the inner skirt and the outer skirt before exiting through the at least one orifice, and wherein an intermediate skirt is positioned between the inner skirt and the outer skirt and has a length selected to provide, in use, a circuitous flow path between the at least one opening and the at least one orifice.

5. The unitary nozzle body of claim 4, wherein the intermediate skirt has a length greater than a length of the inner skirt.

6. The unitary nozzle body of claim 5, wherein the intermediate skirt has a length less than a length of the outer skirt.

7. The unitary nozzle body of claim 4, in combination with an irrigation device having a riser with an open end with inner and outer tubular walls, wherein, when mounted on the riser:

a free end of the inner skirt opposite the top is disposed within the open end of the riser to a depth such that the at least one opening is positioned to permit water exiting the riser into a region within the inner skirt to exit from the region within the inner skirt through the at least one opening; and a free end of the intermediate skirt opposite the top is disposed between the inner and outer tubular walls of the riser such that a flow path between the at least slot and the at least one orifice extends around the free end of the intermediate skirt.

8. The unitary nozzle body of claim 4, in combination with an irrigation device having a riser with an open end with inner and outer tubular walls, wherein, when mounted on the riser:

a free end of the inner skirt opposite the top is disposed within the open end of the riser to a depth such that the at least one opening is positioned to permit water exiting the riser into a region within the inner skirt to exit from the region within the inner skirt through the at least one opening;

a free end of the intermediate skirt opposite the top is disposed between the inner and outer tubular walls of the riser such that a flow path between the at least slot and the at least one orifice extends around the free end of the intermediate skirt; and the outer skirt is disposed about the outer tubular wall of the riser.

9. A unitary nozzle body suitable for attachment to a riser of an irrigation device, the nozzle body comprising a top, an outer skirt depending from the top, an inner skirt spaced inwardly from the outer skirt, and at least one orifice in the outer skirt dimensioned for discharging a stream of water, the outer skirt being configured to permit the nozzle body to be removably attached to a riser of an irrigation device, wherein the inner skirt has at least one opening through which water can pass to a region between the inner skirt and the outer skirt before exiting through the at least one orifice, and wherein the top has a flange extending outwardly beyond the outer skirt, the flange having a plurality of teeth separated by gaps, at least one of the gaps being adjacent one of the orifices and the one of the orifices extends through at least the top of the nozzle body in a gap between adjacent teeth.

10. A unitary nozzle body suitable for attachment to a riser of an irrigation device, the nozzle body comprising a top, an outer skirt depending from the top, an inner skirt spaced inwardly from the outer skirt, and at least one orifice in the outer skirt dimensioned for discharging a stream of water, the outer skirt being configured to permit the nozzle body to be removably attached to a riser of an irrigation device, wherein the inner skirt has at least one opening through which water can pass to a region between the inner skirt and the outer skirt before exiting through the at least one orifice, in combination with an irrigation device having a riser with a tubular open end, wherein, when mounted on the riser, a free end of the inner skirt opposite the top is disposed within the open end of the riser to a depth such that the at least one opening is positioned to permit water exiting the riser into a region within the inner skirt to exit from the region within the inner skirt through the at least one opening.

* * * * *